US006606593B1

(12) United States Patent
Jarvinen et al.

(10) Patent No.: US 6,606,593 B1
(45) **Date of Patent: *Aug. 12, 2003**

(54) METHODS FOR GENERATING COMFORT NOISE DURING DISCONTINUOUS TRANSMISSION

(75) Inventors: Kari Jarvinen, Tampere (FI); Pekka Kapanen, Tampere (FI); Vesa Ruoppila, Tampere (FI); Jani Rotola-Pukkila, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/371,332

(22) Filed: Aug. 10, 1999

Related U.S. Application Data

(63) Continuation of application No. 08/965,303, filed on Nov. 6, 1997, now Pat. No. 5,960,389.

(60) Provisional application No. 60/031,047, filed on Nov. 15, 1996, and provisional application No. 60/031,321, filed on Nov. 19, 1996.

(51) Int. Cl.[7] ..... G10L 19/08

(52) U.S. Cl. ..... 704/223; 704/226

(58) Field of Search ..... 704/223, 226, 704/220, 230, 233, 264, 500, 225, 258, 219; 455/501

(56) References Cited

U.S. PATENT DOCUMENTS

| | | | | |
|---|---|---|---|---|
| 4,969,192 A | | 11/1990 | Chen et al. | 381/31 |
| 5,327,519 A | | 7/1994 | Haggvist et al. | 395/2.28 |
| 5,444,816 A | | 8/1995 | Adoul et al. | 395/2.28 |
| 5,579,433 A | | 11/1996 | Jarvinen | 395/228 |
| 5,630,016 A | * | 5/1997 | Swaminathan et al. | 704/228 |
| 5,794,199 A | | 8/1998 | Rao et al. | 704/258 |
| 5,812,965 A | | 9/1998 | Massaloux | 704/205 |
| 5,978,760 A | * | 11/1999 | Rao et al. | 704/226 |
| 6,269,331 B1 | * | 7/2001 | Alanara et al. | 704/205 |

FOREIGN PATENT DOCUMENTS

| | | |
|---|---|---|
| WO | WO 96/28809 | 9/1996 |
| WO | WO 96/34382 | 10/1996 |

OTHER PUBLICATIONS

Paksoy, E. et al., "Variable Bit–Rate Celp Coding of Speech With Phonetic Classification (1)", European Transactions On Telecommunications And Related Technologies, vol. 5, No. 5, 9/94, pp. 57–67.

Southcott, C.B. et al., Voice Control Of The Pan–European Digital Mobile Radio System:, Communications Technology For The 1990's And Beyond, vol. 2, Nov. 27, 1989, pp. 1070–1074.

"European Digital Cellular Telecommunications Systems (Phase 2); Comfort Noise Aspect For Full Rate Speech Traffic Channels (GSM 06.12)" European Telecommunication Standard, 9/94, pp. 1–10.

"European Digital Cellular Telecommunications System; Half Rate Speech Part 5; Discontinuous Transmission (DTX) For Half Rate Speech Traffic Channels", European Telecommunication Standard, vol. 300 581–5, pp. 1–3,5, 7–16, Nov. 1, 1995.

* cited by examiner

*Primary Examiner*—Daniel Abebe
(74) *Attorney, Agent, or Firm*—Perman & Green, LLP

(57) ABSTRACT

An improved method for generating comfort noise (CN) in a mobile terminal operating in a discontinuous transmission (DTX) mode. In one embodiment the invention provides an improved method for comfort noise generation, in which a random excitation is modified by a spectral control filter so that the frequency content of comfort noise and background noise become similar. In another embodiment the transmitter identifies speech coding parameters that are not representative of the actual background noise, and replaces the identified parameters with parameters having a median value. In this manner the non-representative parameters do not skew the result of an averaging operation.

121 Claims, 22 Drawing Sheets

METHODS FOR GENERATING COMFORT NOISE DURING DISCONTINUOUS TRANSMISSION

RELATED APPLICATIONS

This application is a continuation application, based on U.S. application for Patent, Ser. No. 08/965,303, filed on Nov. 6, 1997, now U.S. Pat. No. 5,960,389, and Applicant claims priority thereof. Said application Ser. No. 08/965,303 claims the benefit of Provisional Application 60/031,047, filed Nov. 15, 1996 and Provisional Application 60/031,321 filed Nov. 19, 1996. The disclosures of the above cited applications are incorporated herein by reference in their entireties.

FIELD OF THE INVENTION

This invention relates generally to the field of speech communication and, more particularly, to discontinuous transmission (DTX) and to improving the quality of comfort noise (CN) during discontinuous transmission.

BACKGROUND OF THE INVENTION

Discontinuous transmission is used in mobile communication systems to switch the radio transmitter off during speech pauses. The use of DTX saves power in the mobile station and increases the time required between battery recharging. It also reduces the general interference level and thus improves transmission quality.

However, during speech pauses the background noise which is transmitted with the speech also disappears if the channel is cut off completely. The result is an unnatural sounding audio signal (silence) at the receiving end of the communication.

It is known in the art, instead of completely switching the transmission off during speech pauses, to generate parameters that characterize the background noise, and to send these parameters over the air interface at a low rate in Silence Descriptor (SID) frames. These parameters are used at the receive side to regenerate background noise which reflects, as well as possible, the spectral and temporal content of the background noise at the transmit side. These parameters that characterize the background noise are referred to as comfort noise (CN) parameters. The comfort noise parameters typically include a subset of speech coding parameters: in particular synthesis filter coefficients and gain parameters.

It should be noted, however, that in some comfort noise evaluation schemes of some speech codecs, part of the comfort noise parameters are derived from speech coding parameters while other comfort noise parameter(s) are derived from, for example, signals that are available in the speech coder but that are not transmitted over the air interface.

It is assumed in prior-art DTX systems that the excitation can be approximated sufficiently well by spectrally flat noise (i.e., white noise). In prior art DTX systems, the comfort noise is generated by feeding locally generated, spectrally flat noise through a speech coder synthesis filter. However, such white noise sequences are unable to produce high quality comfort noise. This is because the optimal excitation sequences are not spectrally flat, but may have spectral tilt or even a stronger deviation from flat spectral characteristics. Depending on the type of background noise, the spectra of the optimal excitation sequences may, for example, have lowpass or highpass characteristics. Because of this mismatch between the random excitation and the correct or optimal excitation the comfort noise generated at the receive side sounds different from the background noise on the transmit side. The generated comfort noise may, for example, sound considerably "brighter" or "darker" than it should be. During DTX, the spectral content of the background noise thus changes between active speech (i.e., speech coding on) and speech pauses (i.e., comfort noise generation on). This audible difference in the comfort noise thus causes a reduction in the transmission quality which can be perceived by a user.

In speech coding systems, such as in the full rate (FR), half rate (HR), and enhanced full rate (EFR) speech channels of the GSM system, the comfort noise parameters are transmitted at a low rate. By example, in the FR and EFR channels this rate is only once per every 24 frames (i.e., every 480 milliseconds). This means that comfort noise parameters are updated only about twice per second. This low transmission rate cannot accurately represent the spectral and temporal characteristics of the background noise and, therefore, some degradation in the quality of background noise is unavoidable during DTX.

A further problem that arises during DTX in digital cellular systems, such as GSM, relates to a hangover period of a few speech frames that is introduced after a speech burst, and before the actual transmission is terminated. If the speech burst is below some threshold duration, it can be interpreted as a background noise spike, and in this case the speech burst is not followed by a hangover period. The hangover period is used for computing an estimate of the characteristics of the background noise on the transmit side to be transmitted to the receive side in a comfort noise parameter message (or Silence Descriptor (SID) frame), before the transmission is terminated. As was described above, the transmitted background noise estimate is used on the receive side to generate comfort noise with characteristics similar to the transmit side background noise at the time the transmission is terminated.

In known types of DTX mechanisms similar to those of GSM FR and HR, non-predictive comfort noise quantization schemes are employed. Due to this, the receive side does not have to know if a hangover period exists at the end of a speech burst. However, in GSM EFR, efficient predictive comfort noise quantization schemes are employed, and the existence of a hangover period is locally evaluated at the receive side to assist in comfort noise dequantization. This involves a small computational load and a number of program instructions to be executed.

Another problem arises if the background noise on the transmit side is not stationary but varies considerably. In this case there may exist a single frame or a small number of frames within an averaging period for which some or all of the speech coding parameters provide a poor characterization of the typical background noise. A similar situation may occur when a Voice Activity Detection or VAD algorithm interprets the unvoiced end of the period of active speech as "no speech", or the stationary background noise contains strong impulse-type noise bursts. Because of the short duration of the averaging periods in known types of DTX systems such ill-conditioned speech coding parameters may change the result of the averaging significantly enough that the resulting averaged CN parameters do not accurately characterize the background noise. This results in a mismatch either in the level or in the spectrum, or both, between the background noise and the comfort noise. The quality of transmission is thus impaired as the background noise sounds different to the user depending on whether it is received during speech (normal speech coding of speech and background noise) or during speech pauses (produced by comfort noise generation).

In greater detail, during the DTX hangover period any frames declared by the VAD algorithm as being "no speech" frames are sent over the air interface, and the speech coding parameters are buffered to be able to evaluate the comfort noise parameters for a first SID frame. The first SID frame is transmitted immediately after the end of the DTX hangover period. The length of the DTX hangover period is thus determined by the length of the averaging period. Therefore, to minimize the channel activity of the system, the averaging period should be fixed at a relatively short length.

Before describing the present invention, it will be instructive to review conventional circuitry and methods for generating comfort noise parameters on the transmit side, and for generating comfort noise on the receive side. In this regard reference is thus first made to FIGS. 1*a*–1*d*.

Referring to FIG. 1*a*, short term spectral parameters 102 are calculated from a speech signal 100 in a Linear Predictive Coding (LPC) analysis block 101. LPC is a method well known in the prior art. For simplicity, discussed herein is only the case where the synthesis filter has only a short term synthesis filter, it being realized that in most prior art systems, such as in GSM FR, HR and EFR coders, the synthesis filter is constructed as a cascade of a short term synthesis filter and a long term synthesis filter. However, for the purposes of this description a discussion of the long term synthesis filter is not necessary. Furthermore, the long term synthesis filter is typically switched off during comfort noise generation in prior art DTX systems.

The LPC analysis produces a set of short term spectral parameters 102 once for each transmission frame. The frame duration depends on the system. For example, in all GSM channels the frame size is set at 20 milliseconds.

The speech signal is fed through an inverse filter 103 to produce a residual signal 104. The inverse filter is of the form:

$$A(z) = 1 - \sum_{i=1}^{M} a(i)z^{-i}. \tag{1}$$

The filter coefficients a(i), i=1, . . . , M are produced in the LPC analysis and are updated once for each frame. Interpolation as is known in prior art speech coding may be applied in the inverse filter 103 to obtain a smooth change in the filter parameters between frames. The inverse filter 103 produces the residual 104 which is the optimal excitation signal, and which generates the exact speech signal 100 when fed through synthesis filter 1/A(z) 112 on the receive side (see FIG. 1*b*). The energy of the excitation sequence is measured and a scaling gain 106 is calculated for each transmission frame in excitation gain calculation block 105.

The excitation gain 106 and short term spectral coefficients 102 are averaged over several transmission frames to obtain a characterization of the average spectral and temporal content of the background noise. The averaging is typically carried out over four frames for the GSM FR channel to eight frames, as is the case for the GSM EFR channel. The parameters to be averaged are buffered for the duration of the averaging period in blocks 107*a* and 108*a* (see FIG. 1*d*). The averaging process is carried out in blocks 107 and 108, and the average parameters that characterize the background noise are thus generated. These are the average excitation gain $g_{mean}$ and the average short term spectral coefficients. In modern speech codecs, there are typically 10 short term spectral coefficients (M=10) which are usually represented as Line Spectral Pair (LSP) coefficients $f_{mean}$ (i), i=1, . . . , M, as in the GSM EFR DTX system. Although these parameters are typically quantized prior to transmission, the quantization is ignored in this description for simplicity, in that the exact type of quantization that is performed is irrelevant to an understanding of the operation of the invention as described below.

Referring briefly to FIG. 1*d*, it is shown that the averaging blocks 107 and 108 each typically include the respective buffers 107*a* and 108*a*, which output buffered signals 107*b* and 108*b*, respectively, to the averaging blocks. Greater attention will be paid to the buffers 107*a* and 108*a* below when describing the embodiments of the invention shown in FIGS. 4 and 5.

The computation and averaging of the comfort noise parameters is explained in detail in GSM recommendation: GSM 06.62 "Comfort noise aspects for Enhanced Full Rate (EFR) speech traffic channels". Also by example, discontinuous transmission is explained in GSM recommendation: GSM 06.81 "Discontinuous Transmission (DTX) for Enhanced Full Rate (EFR) for speech traffic channels", and voice activity detection (VAD) is explained in GSM recommendation: GSM 06.82 "Voice Activity Detection (VAD) for Enhanced Full Rate (EFR) speech channels". As such, the details of these various functions are not further discussed here.

Referring to FIG. 1*b*, there is shown a block diagram of a conventional decoder on the receive side that is used to generate comfort noise in the prior art speech communication system. The decoder receives the two comfort noise parameters, the average excitation gain $g_{mean}$ and the set of average short term spectral coefficients $f_{mean}$ (i), i=1, . . . M, and based on the parameters the decoder generates the comfort noise. The comfort noise generation operation on the receive side is similar to speech decoding, except that the parameters are used at a significantly lower rate (e.g., once every 480 milliseconds, as in the GSM FR and EFR channels), and no excitation signal is received from the speech encoder. During speech decoding the excitation on the receive side is obtained from a codebook that contains a plurality of possible excitation sequences, and an index for the particular excitation vector in the codebook is transmitted along with the other speech coding parameters. For a detailed description of speech decoding and the use of codebooks reference can be had to, by example, U.S. Pat. No. : 5,327,519, entitled "Pulse Pattern Excited Linear Prediction Voice Coder", by Jari Hagqvist, Kari Jarvinen, Kari-Pekka Estola, and Jukka Ranta, the disclosure of which is incorporated by reference herein in its entirety.

During comfort noise generation, however, no index to the codebook is transmitted, and the excitation is obtained instead from a random number or excitation (RE) generator 110. The RE generator 110 generates excitation vectors 114 having a flat spectrum. The excitation vectors 114 are then scaled by the average excitation gain $g_{mean}$ in scaling unit 115 so that their energy corresponds to the average gain of the excitation 104 on the transmit side. A resulting scaled random excitation sequence 111 is then input to the speech synthesis filter 112 to generate the comfort noise output signal 113. The average short term spectral coefficients $f_{mean}$(i) are used in the speech synthesis filter 112.

FIG. 1*c* illustrates the spectrum associated with the signal in different parts of the prior art decoder of FIG. 1*b*. The RE-generator 110 produces the random number excitation sequences 114 (and the scaled excitation 111) having a flat spectrum. This spectrum is shown by curve A. The speech synthesis filter 112 then modifies the excitation to produce a non-flat spectrum as shown in curve B.

As was discussed above, a number of problems exist with respect to conventional comfort noise generation techniques. These problems include the mismatch between the random excitation and the correct or optimal excitation which results in the comfort noise generated at the receive side sounding different from the actual background noise on the transmit side. It is a goal of this invention to reduce or eliminate these problems.

OBJECTS AND ADVANTAGES OF THE INVENTION

It is thus a first object and advantage of this invention to provide an improved method for generating comfort noise during discontinuous transmission, and to minimize a loss of signal quality due to the use of discontinuous transmission.

It is a further object and advantage of this invention to provide improved comfort noise generation methods that are able to better characterize background noise, and that further provide an improved quality of comfort noise and an improved quality of transmission during discontinuous transmission.

It is another object and advantage of this invention to provide an enhanced comfort noise generation technique that eliminates or minimizes the generation of non-representative comfort noise, and which employs a reduced averaging time.

SUMMARY OF THE INVENTION

The foregoing and other problems are overcome and the objects and advantages of the invention are realized by methods and apparatus in accordance with embodiments of this invention, wherein an improved method for generating comfort noise (CN) in discontinuous transmission (DTX) is provided.

The invention provides an improved method for comfort noise generation, in which the random excitation is modified by a spectral control filter so that the frequency content of comfort noise and background noise become similar.

In accordance with the teaching of this invention the conventional random excitation with flat spectral distribution is not used as the excitation during comfort noise generation. Instead the random excitation is suitably modified so that the comfort noise more accurately characterizes the spectrum of the background noise that is present on the transmit side of the communication. This results in an improved quality of comfort noise.

Steps of the method of this invention include calculating random excitation spectral control (RESC) parameters on the transmit side. On the receive side, the spectral control parameters are used to modify the random excitation so that the spectral content of the generated or produced comfort noise matches more accurately that of the actual background noise at the transmit side. The random excitation spectral control (RESC) parameters are calculated during speech pauses, together with the rest of the comfort noise parameters, and are then transmitted to the receive side.

In accordance with a method of this invention, a first step calculates random excitation spectral control (RESC) parameters on the transmit side. These parameters are transmitted to the receive side together with other CN-parameters. On the receive side, the RESC-parameters are used for shaping the spectral content of excitation prior to applying it to the synthesis filter.

Further in accordance with this invention all or a predetermined number of ill-conditioned speech coding parameters within an averaging period are removed, or replaced by applying a median replacement method, when the parameters are averaged. In this embodiment of the invention steps are executed of measuring the distances of the speech coding parameters from each other between individual frames within an averaging period, ordering these parameters according to the measured distances, finding the parameters which have the largest distances to the other parameters within the averaging period, and, if the distances exceed a predetermined threshold, replacing these parameters with a parameter which has a smallest measured distance (i.e., a median value) to the other parameters within the averaging period. The median valued parameter is considered to have a value which is the most faithful representation of the characteristics of the background noise among the parameters within the averaging period. After this procedure, the averaging of the speech coding parameters may be performed in any desired manner. Furthermore, the teaching of this embodiment of the invention does not change the way in which the CN parameters are received and used on the receive side of the DTX system.

In addition to removing the ill-conditioned CN parameters from the averaging period, and thereby improving the comfort noise quality, this embodiment of the invention provides other advantages. For example, in prior art DTX systems a longer averaging period is required to be used in order to reduce the effect of the ill-conditioned parameters in the averaging. The use of this invention beneficially allows the use of a shorter averaging period than in prior art DTX systems, since the effect of the ill-conditioned parameters on the averaging operation is reduced. Also, in the prior art DTX systems a longer hangover period is required due to the longer averaging period, thereby increasing the channel activity. The shorter averaging period made possible by this embodiment of the invention thus also enables the DTX hangover period to be reduced, and thereby reduces channel activity. Furthermore, in the prior art DTX systems, due to the longer averaging period employed, a significant amount of static memory is required by the CN averaging algorithm. A further advantage of the shortened averaging period achieved by this invention is a reduction in an amount of static memory required by the CN averaging algorithm.

BRIEF DESCRIPTION OF THE DRAWINGS

The above set forth and other features of the invention are made more apparent in the ensuing Detailed Description of the Invention when read in conjunction with the attached Drawings, wherein:

FIG. 12 illustrates a mobile station suitable for practicing this invention, while

DETAILED DESCRIPTION OF THE INVENTION

Figure 1A:
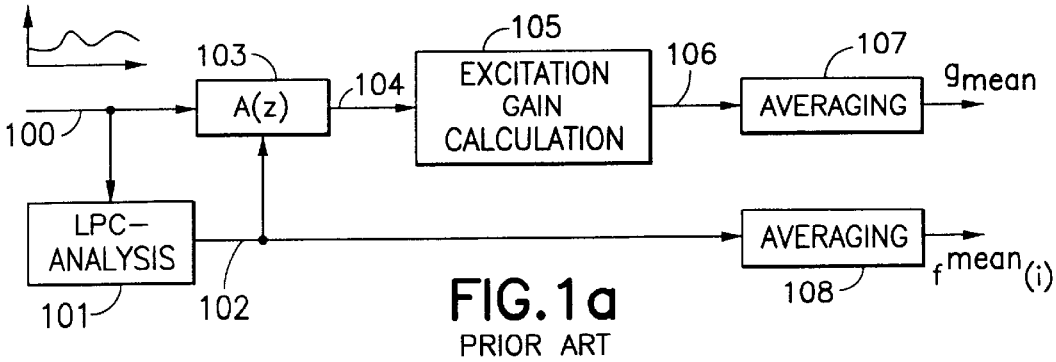
FIG. 1a PRIOR ART
FIG. 1*a* is a block diagram of conventional circuitry for generating comfort noise parameters on the transmit side.
Figure 1B:
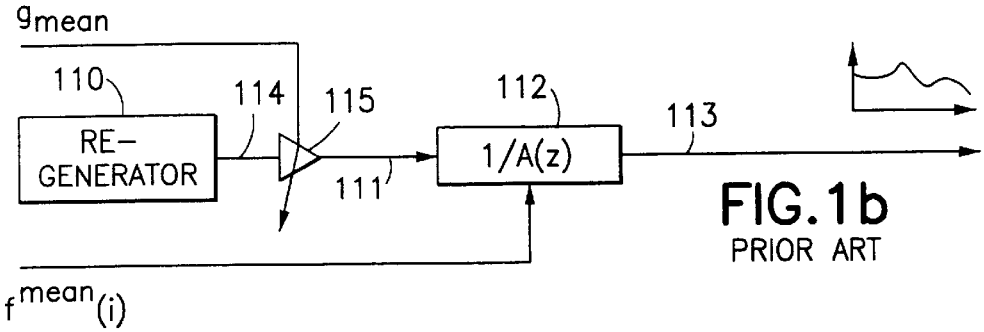
FIG. 1b PRIOR ART
FIG. 1*b* is a block diagram of a conventional decoder on the receive side that is used to generate comfort noise.
Figure 2A:
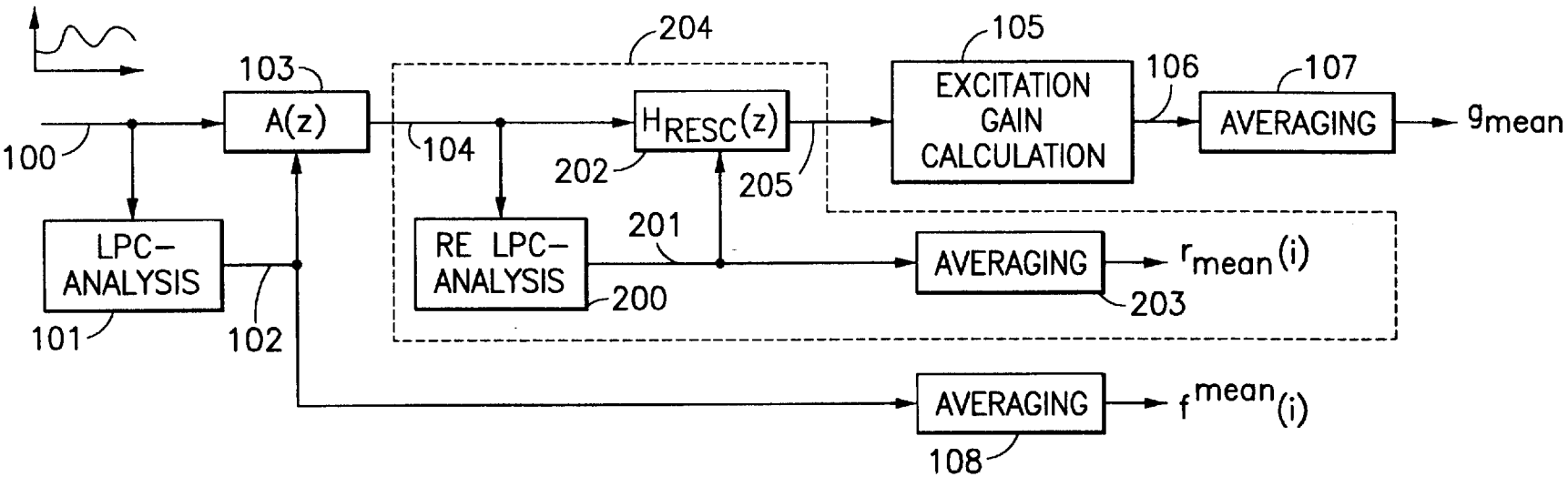
FIG. 2*a* is a block diagram of circuitry for generating comfort noise parameters on the transmit side in accordance with this invention.
Figure 2B:
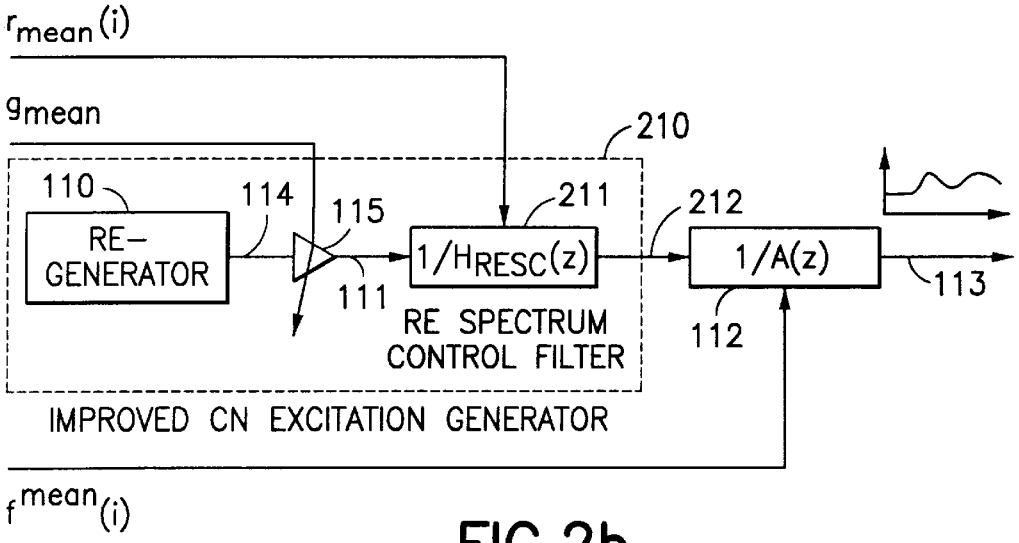
FIG. 2*b* is a block diagram of a decoder on the receive side that is used to generate comfort noise in accordance with this invention.
Figure 2C:
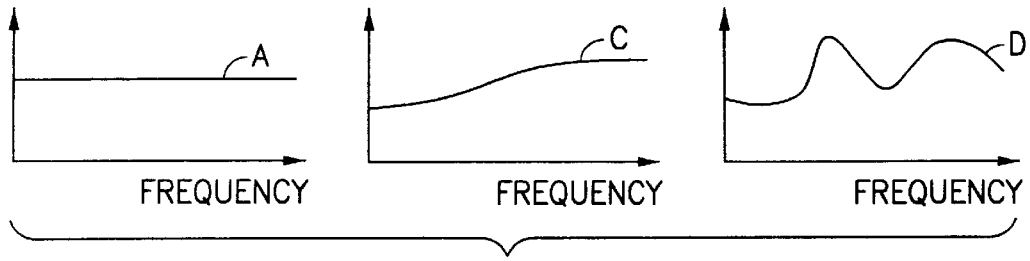
FIG. 2*c* illustrates the spectrum associated with the decoder of FIG. 2*b*.

A description was made previously of a conventional technique for both encoding and decoding comfort noise. Reference is now made to FIGS. 2*a*–2*c* for showing a first embodiment of circuitry and a method in accordance with this invention. In FIGS. 2*a* and 2*b* those elements that appear also in FIGS. 1*a* and 1*b* are numbered accordingly.

It is first noted that "SID averaging period" is a GSM-related phrase, while "comfort noise averaging period" or "CN averaging period" is an IS-641, Rev. A -related phrase. For the purposes of this invention these two phrases may be used interchangeably in the following description. Likewise, the phrases "SID frame" and "comfort noise parameter message" or "CN" parameter message" may be used interchangeably.

In FIG. 2*a* there is shown a block diagram of apparatus for producing comfort noise parameters on the transmit side according to the present invention. The novel operations according to the present invention are separated from those known from the prior art by a dashed line 204. According to this embodiment of the invention, the residual signal 104 output from the inverse filter 103 is subjected to a further analysis (such as LPC-analysis) to produce another set of filter coefficients. The second analysis, which is referred to herein as random excitation (RE) LPC-analysis 200, is typically of a lower degree than the LPC analysis carried out in block 101. The random excitation spectral control (RESC) parameters, $r_{mean}$ (i), i=1, . . . ,R, are obtained by averaging the spectral parameters 201 from the RE LPC-analysis block 200 over several consecutive frames in averaging block 203. The RESC parameters characterize the spectrum of the excitation.

It should be noted that the RESC parameters are not a subset of the speech coding parameters, but are generated and used only during comfort noise generation. The inventors have found that first or second order LPC-analysis is sufficient to generate the RESC parameters (R=1 or 2). However, spectral models other than the all-pole model of the LPC technique may also be used. The averaging may alternatively be carried out by the RE LPC analysis block 200 by averaging the autocorrelation coefficients within the LPC parameter calculation, or by any other suitable averaging technique within the LPC coefficient computation. The averaging period for the RESC parameters may be the same as that used for the other CN parameters, but is not restricted to only the same averaging period. For example, it has been found that longer averaging than what is used for the conventional CN-parameters can be advantageous. Thus, instead of using an averaging period of seven frames, a longer averaging period may be preferred (e.g., 10–12 frames).

Prior to calculating the excitation gain, the LPC-residual 104 is fed through a second inverse filter $H_{RESC}(Z)$ 202. This filter produces a spectrally controlled residual 205 which generally has a flatter spectrum than the LPC-residual 104. The random excitation spectral control (RESC) inverse filter $H_{RESC}(z)$ may be of the form of an all-zero filter (but not restricted to only this form):

$$H_{RESC}(z) = 1 - \sum_{i=1}^{R} b(i)z^{-i}. \tag{2}$$

The excitation gain is calculated from the spectrally flattened residual 205. Otherwise the operations in FIG. 2*a* are similar to those described above with regard to FIG. 1*a*.

Referring now to FIG. 2*b*, there is shown a block diagram of decoder on the receive side that is used to generate comfort noise according to the present invention. In the decoder, the excitation 212 is formed by first generating the white noise excitation sequence 114 with the random excitation generator 110, which is then scaled by $g_{mean}$ in scaling block 115.

The spectrally flat noise sequence 111 is then processed in a random excitation spectral control (RESC) filter 211, which produces an excitation having a correct spectral content. The RE spectral control filter 211 performs the inverse operation to the RESC inverse filter 202 employed in the encoder of FIG. 2*a*. Using the RESC inverse filter of equation (2) on the transmit side, the RE spectral control filter 211 used on the receive side is of the form $$1/H_{RESC}(z) = \frac{1}{1 - \sum_{i=1}^{R} b(i)z^{-i}}. \tag{3}$$

The RESC-parameters $r_{mean}$(i), i=1, . . . ,R that define the filter coefficients b(i), i=1, . . . , R are transmitted as part of the CN parameters to the receive side, and are used in the RE spectral control filter 211 so that the excitation for the synthesis filter 112 is suitably spectrally weighted, and is thus generally not spectrally flat. The RESC parameters $r_{mean}(i)$, i=1, . . . ,R may be the same as the filter coefficients b(i), i=1, . . . ,R, or they may use some other parameter representation that enables efficient quantization for transmission, such as LSP coefficients. FIGS. 11*a*–11*g* illustrate exemplary frequency responses of the RESC filter 211.

It can be appreciated that this invention thus provides a novel CN-excitation generator 210. In review, the novel CN-excitation generator 210 generates a spectrally flat random excitation in the RE generator 110. The spectrally flat excitation is then suitably scaled by the average gain scaler 115. To produce the correct spectrum for the comfort noise, and to avoid a mismatch between the spectrum of the comfort noise and that of the background noise, the random excitation is fed through the RE spectral control filter 211. The spectrally controlled excitation 212 is then used in the speech synthesis filter 112 to produce comfort noise that has an improved match to the spectrum of the actual background noise that is present at the transmit side.

The RESC parameters are not a subset of the speech coding parameters that are used during speech signal processing, but are instead calculated only during the comfort noise calculation. The RESC parameters are computed and transmitted only for the purpose of generating improved excitation for comfort noise during speech pauses. The RESC inverse filter 202 in the encoder and the RESC filter 211 in the decoder are used only for the purpose of controlling the spectrum of the random excitation.

Figure 1C:
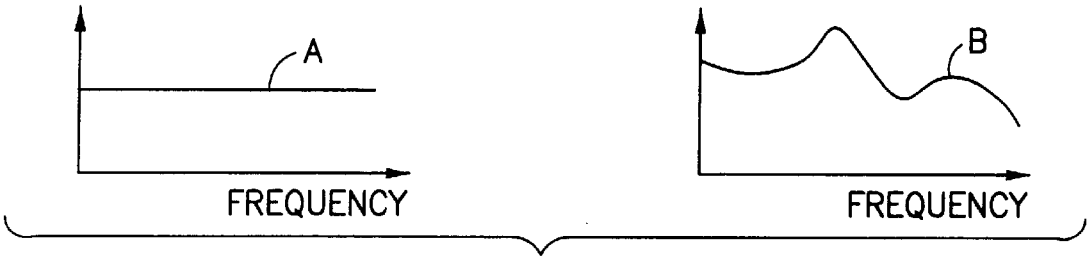
FIG. 1c PRIOR ART
Fig. 1*c* illustrates the spectrum associated with the signal in different parts of the prior-art decoder of FIG. 1*b*.
Figure 1D:
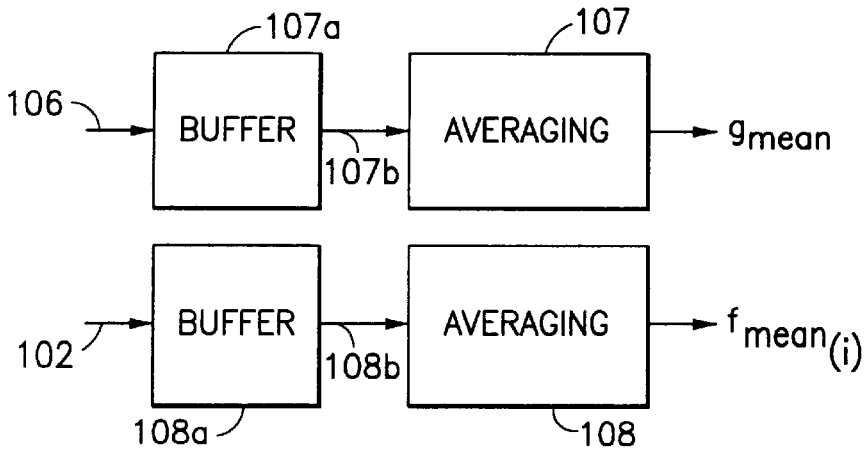
FIG. 1d PRIOR ART
FIG. 1*d* illustrates in greater detail the averaging blocks shown in FIG. 1*a*.

FIG. 2*c* illustrates the spectrum of certain signals within the decoder of FIG. 2*b* during the generation of comfort noise according to the present invention. The RE generator 110 produces the random number sequences having the flat spectrum shown in curve A. This spectrum is identical to that shown in curve A of FIG. 1*c*. Signals 114 and 111 both have this flat spectrum, it being noted that the gain scaling that occurs in block 115 does not affect the shape of the spectrum. The white noise sequence 111 is then fed through RE spectrum control filter 211 to produce the excitation 212 to the LPC synthesis filter. The improved excitation sequence 212 generally has a non-flat spectrum (curve C), and the effect of this non-flat spectrum is observed in the spectrum of the output signal 113 of the synthesis filter 112 (curve D). The excitation sequence 212 may be lowpass or highpass type, or may exhibit a more sophisticated frequency content (depending on the degree of the RESC filter). The spectrum control is determined by the RESC parameters, which are computed on the transmit side and transmitted as part of comfort noise to the receive side, as was described above.

Figure 3A:
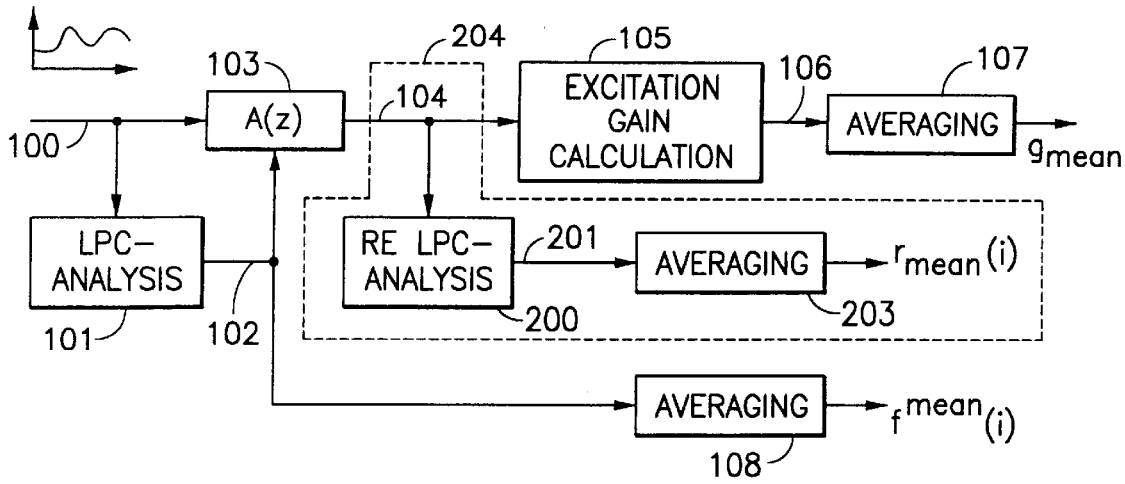
FIG. 3*a* is a block diagram of a second embodiment of circuitry for generating comfort noise parameters on the transmit side in accordance with this invention.
Figure 3B:
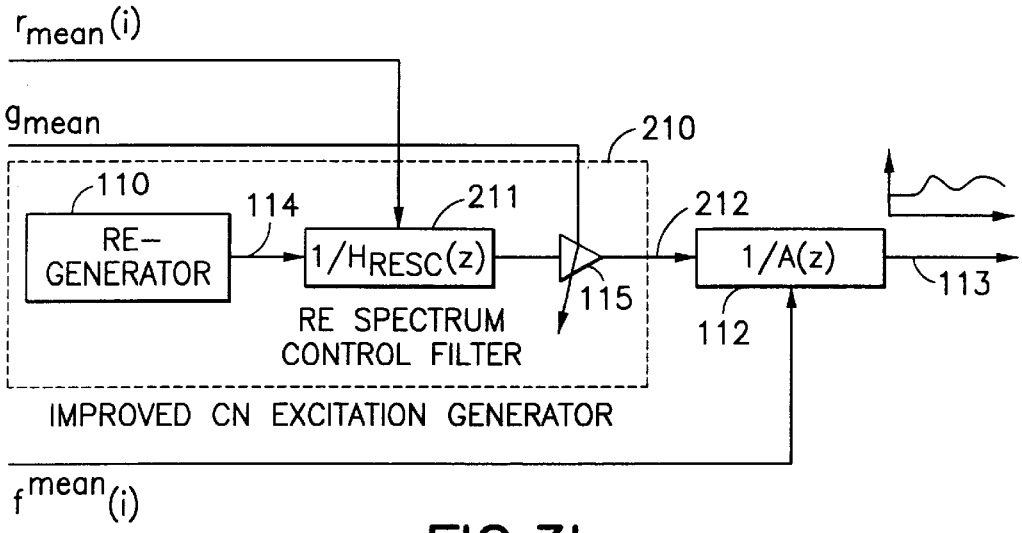
FIG. 3*b* is a block diagram of a second embodiment of decoder on the receive side in accordance with this invention.

FIGS. 3*a* and 3*b* illustrate a further embodiment of this invention. Contrasting FIG. 3*a* to FIG. 2*a*, it can be observed that the calculation of the excitation gain in this embodiment is carried out from the LPC residual 104, and not from the residual from the RESC inverse filter 202. The RESC inverse filter 202 is thus not required in the embodiment of FIG. 3*a,* and can be eliminated. The decoder on the receive side for use with the encoder of FIG. 3*a* is shown in FIG. 3*b*. When compared to FIG. 2*b,* it can be noted that the scaling (block 115) of the excitation is moved to the output of the RE spectrum control filter 211. Otherwise the operation of the encoder and decoder of FIGS. 3*a* and 3*b* is similar to that shown in FIGS. 2*a* and 2*b*.

Figure 4:
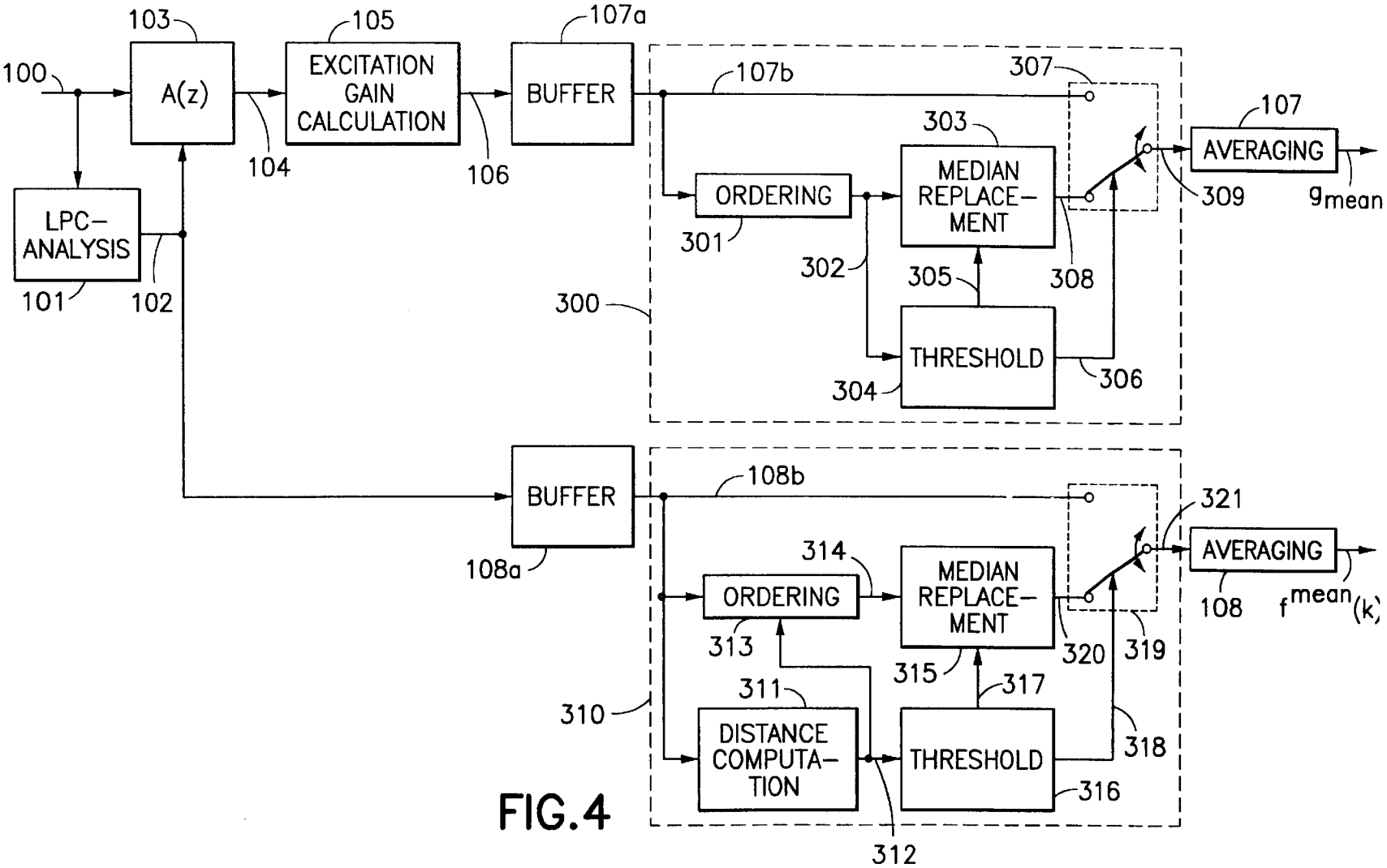
FIGS. 4 and 5 are each a block diagram of circuitry for evaluating comfort noise parameters on the transmit side of a DTX digital communications system in accordance with embodiments of this invention.

Referring now to FIG. 4, there is shown a block diagram of circuitry for evaluating comfort noise parameters on the TX side according to a further embodiment of this invention. This embodiment addresses the above-mentioned problems that arise when there exists a single frame or a small number of frames within an averaging period for which some or all of the speech coding parameters give a poor characterization of the typical background noise. The operations according to this embodiment of the invention are separated from those known from the prior art by the dashed lines 300 and 310. According to this embodiment of the invention, the speech coding parameters which are buffered in block 107*a* and 108*a* are subjected to a thresholded median replacement process before they are applied to averaging blocks 107 and 108 for computing the average excitation gain $g_{mean}$ and the average short term spectral coefficients $f_{mean}(i)$ In this process, the parameters within the averaging period which have non-typical values of the background noise are replaced, if specific conditions are met, by the parameter values which are considered as typical of the actual background noise, i.e., the median values.

First, the operations indicated by the block 300 that are performed on the scalar valued excitation gain parameters g prior to averaging in block 107 are discussed. The set of excitation gain values 107*b* buffered in block 107*a* over the averaging period are forwarded to block 301, in which they are ordered according to their values. Each of the excitation gain values has its own index within the set. The ordered set of gain parameters 302 is forwarded to a median replacement block 303, in which those L excitation gain values differing the most from the median value, while the difference exceeds the predetermined threshold value, are replaced by the median value of the parameter set. The differences between each individual parameter value and the median value are computed in block 304, and the indices of the excitation gain values for which the absolute value of this computed difference exceeds a threshold are communicated as signal 305 to the median replacement block 303.

The length N of the averaging period is preferably an odd number. In this case, the median of the ordered set is its ((N+l)/2)th element. The variable L, which determines the number of replaced parameters, may assume a value between 0 and N-1. L may also be a predetermined value (i.e., a constant).

If there exist individual excitation gain values such that the difference between the excitation gain value and the median value exceeds the predetermined threshold, the selector 307 is switched to the position in which excitation gain values 309 for the averaging block 107 are obtained from the median replacement block 303 as signal 308. However, if for each of the excitation gain values the difference between the gain value and the median value does not exceed the predetermined threshold, the selector 307 is switched such that the parameters 309 input to the averaging block 107 are obtained directly from the buffer block 107*a*.

The switching state of selector 307 is controlled by the threshold block 304 with signal 306.

Next, the operations of block 310 are discussed with regard to the LSP coefficients f(k), k=1, . . . ,M, prior to averaging in block 108. The set of LSP coefficients 108*b* buffered in block 108*a* over the averaging period are forwarded to block 311. The spectral distance of the LSP coefficients $f_i(k)$ of the ith frame in the averaging period, to the LSP coefficients $f_j(k)$ of the jth frame in the averaging period, is approximated according to the following equation:

$$\Delta R_{ij} = \sum_{k=1}^{M} (f_i(k) - f_j(k))^2, \tag{4}$$

where M is the degree of the LPC model, and $f_i(k)$ is the kth LSP parameter of the ith frame in the averaging period.

To find the spectral distance $\Delta S_i$ of the LSP coefficients $f_i(k)$ of frame i to the LSP coefficients of all the other frames j=1, . . . ,N, i≠j, within the averaging period of length N, the sum of the spectral distances $\Delta R_{ij}$ is calculated as follows:

$$\Delta S_i = \sum_{j=1, j\neq i}^{N} \Delta R_{ij}, \tag{5}$$

for all i=1, . . . ,N($\Delta R_{ij}$=0 (i.e., the distance of a parameter from itself is zero). The operations expressed in equations (4) and (5) are carried out in block 311.

The spectral distance can be approximated using a number of other representations of the LPC filter, for example, see A. H. Gray, Jr. and J. D. Markel, "Distance measures for speech processing," IEEE Transactions on Acoustics, Speech, and Signal Processing, Vol. 24, pp. 380–391, 1976. Also Immittance Spectral Pairs (ISP) can be utilized similarly as line spectral pairs, for example see Y. Bistritz and S. Peller, "Immittance spectral pairs (ISP) for speech encoding," in Proceedings of IEEE International Conference on Acoustics, Speech, and Signal Processing, Minneapolis, Minn., Vol. 2, pp. 9–12, Apr. 27–30, 1993.

After the spectral distances $\Delta S_i$ have been found in block for each of the LSP vectors $f_i$ within the averaging period, these distances 312 are forwarded to block 313. In the ordering block 313, the spectral distances are ordered according to their values. Each of the spectral distance values is related by an index to one LSP vector within the averaging period. The vector $f_i$ with the smallest distance $\Delta S_i$ within the averaging period i=1, 2, . . . , N is considered as the median vector $f_{med}$ of the averaging period. Its distance is denoted as $\Delta S_{med}$.

The set of LSP coefficient vectors $f_i$ within the averaging period are ordered in block 313 according to the ordering found for the spectral distances. This ordered set of LSP vectors 314 obtained from block 313 is forwarded to the median replacement block 315. In block 315, P (0≦P≦N−1) LSP vectors $f_i$ are replaced by the median $f_{med}$. The indices of these P vectors are determined by comparing $\Delta S_i$ for i=1,2, . . . ,N with the median $\Delta S_{med}$ in block 316. Hence the indices of $f_i$ for which $\Delta S_i - \Delta S_{med}$ is greater than a threshold are communicated by signal 317 to the median replacement block 315.

If the difference $\Delta S - \Delta S_{med}$ is greater than a threshold for some i=1,2, . . . , N, the selector 319 is switched into such a position that the averaging block 108 receives the parameters 321 from the median replacement block 315 as signal 320. However, if $\Delta S_i - \Delta S_{med}$ is smaller than a threshold for all i=1,2, . . . , N, the selector 319 is switched to the position in which the input signal 321 to the averaging block 108 is obtained directly from the buffer block 108(*a*) through signal 108(*b*).

The selector 319 is controlled by the threshold block 316 with signal 318.

Figure 5:
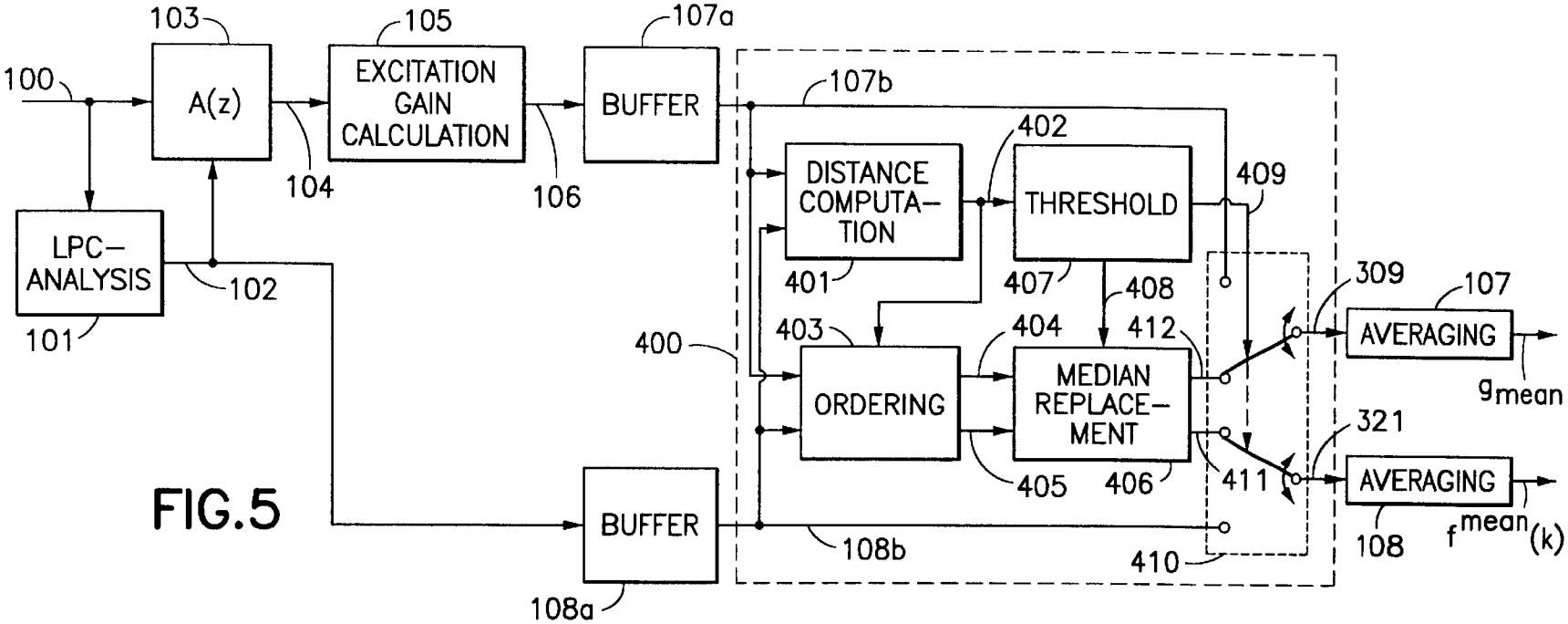

FIG. 5 shows another embodiment of the invention. In this embodiment the operations according to this invention are distinguished from those known from the prior art by the dashed line 400. While in the embodiment shown in FIG. 4 and described above the median operations are performed independently for the excitation gain values g and the LSP vectors $f_i$, in the embodiment of FIG. 5 these two parameter sets are handled together as-follows.

If it is determined that the parameters in an individual frame are to be replaced by the median values, then both the excitation gain value g and the LSP vectors $f_i$ of that frame are replaced by the respective parameters of the frame containing the median parameters.

In order to find the ordering of the frames for median replacement, the equation (4) of the approximated distance $\Delta R_{ij}$ between the parameters of the ith frame and the jth frame of the averaging period is revised to take into account both the excitation gain value g and the LSP vector $f_i$ as follows:

where M is the degree of the LPC model, $f_i(k)$ is the kth $$\Delta T_{ij} = \sum_{k=1}^{M} (f_i(k) - f_j(k))^2 + w(g_i - g_j)^2, \tag{6}$$

LSP parameter of the ith frame of the averaging period, and $g_i$ is the excitation gain parameter of the ith frame.

To find the distance $\Delta S_i$ of the parameters of frame i, for all i=1, . . . ,N, to the parameters of all the other frames j=1, . . . ,N, i≠j within the averaging period of length N, equation (5) is applied after computing $\Delta T_{ij}$. Distance $\Delta T_{ij}$ is then used instead of distance $\Delta R_{ij}$ in equation (5). The procedures expressed by equations (5) and (6) are carried out in block 401. The weighting factor w is chosen to obtain a subjectively preferred compromise between performing the median replacement according to the excitation gain values or according to the spectral distances. The subjectively preferred compromise is found by carrying out tests with typical users.

After the distances $\Delta S_i$ have been found in block 401 for each of the frames within the averaging period, these distances 402 are forwarded to ordering block 403. In the ordering block 403 the distances are ordered according to their values. Each of the distances is related by an index to one frame within the averaging period. The frame with the smallest distance $\Delta S_i$ within the averaging period i=1,2, . . . , N is considered as the median frame of the averaging period, with parameters $g_{med}$ and $f_{med}$. Its distance is denoted as $\Delta S_{med}$.

The excitation gain values to be ordered in block 403 are forwarded to the block by signal 107*b* from buffer 107*a*, and the LSP coefficients are forwarded to the block by signal 108*b* from buffer 108*a*. As was stated above, the set of parameters within the averaging period are ordered in block 403 according to the ordering found for their spectral distances $\Delta S_i$. The ordered set of parameters obtained from block 403 is forwarded as signals 404 and in 405 to the median replacement block 406. In block 406, parameters $g_i$ and $f_i$ of L (0≦L≦N−1) frames are replaced by the parameters $g_{med}$ and $f_{med}$ of the median frame. The indices of these L vectors are determined by comparing $\Delta S_i$ for i=1,2, . . . , N with the median $\Delta S_{med}$ in block 407, and communicated to the median replacement block 406 as signal 408. If the difference $\Delta S_i - \Delta S_{med}$ is greater than a threshold in block 407, the parameters $g_i$ and $f_i$ are replaced by $g_{med}$ and $f_{med}$ in median replacement block 406. The value of L may be bounded by pre-determined minimum and maximum values.

If the difference $\Delta S_i - \Delta S_{med}$ is greater than a threshold for some i=1,2, . . . , N, the selector 410 is switched such that the averaging block 108 receives the parameters 321 from the median replacement block 406 as signal 411, and the averaging block 107 receives the parameters 309 from the median replacement block 406 as signal 412. However, if $\Delta S_i - \Delta S_{med}$ is smaller than a threshold for all i=1,2, . . . , N, the selector 410 is switched to such that the input signal 321 to the averaging block 108 is obtained directly from the buffer block 108*a* through signal 108*b*, and the input signal 309 to the averaging block 107 is obtained directly from the buffer block 107*a* through signal 107*b*. The selector 410 is controlled by the threshold block 407 with signal 409.

In addition to subtracting the median distance from an individual distance (i.e., by computing $\Delta S_i - \Delta S_{med}$) , the differences between each individual distance and the median distance can be computed in blocks 316 and 407 by, for example, dividing an individual distance by the median distance (i.e., by computing $\Delta S_i / \Delta S_{med}$). This may be a preferred method in most cases, since it finds a relative, or normalized, deviation of an individual distance from the median distance, independent of the absolute values of the distances $\Delta S_i$ and $\Delta S_{med}$.

Figure 6:
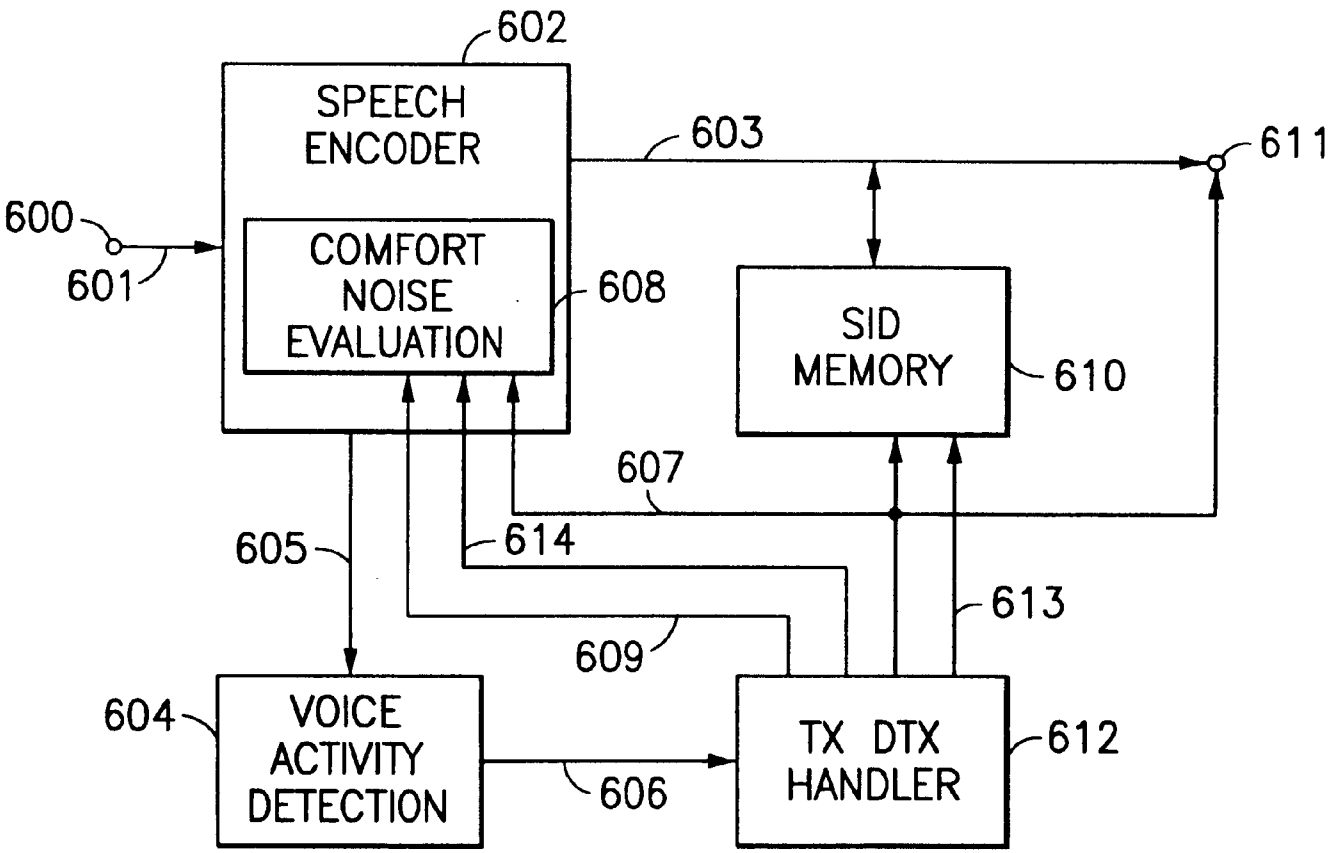
FIG.6 PRIOR ART
FIG. 6 is a block diagram of a conventional speech encoder.

Before now describing a further embodiment of this invention reference is made to FIG. 6, which is a simplified block diagram of the transmit (TX) side speech encoder DTX system. The incoming signal 601 from an analog-to-digital converter 600 is processed frame by frame in the speech encoder 602. As before, the length of the frame is typically 20 msec. The sampling frequency of the speech signal 601 is generally 8 kHz. The speech encoder 602 encodes the input speech frame by frame into a set of parameters 603 which are sent to the radio subsystem 611 of the digital mobile radio unit for transmitting to the receive (RX) side.

The operation of the DTX mechanism is indirectly controlled by a voice activity detection (VAD) performed on the TX side. The basic function of the VAD 604 is to distinguish between noise with speech present and noise without speech present. The VAD 604 operates continuously to evaluate whether the input signal contains speech or does not contain speech. The operation of the VAD 604 is based on the speech encoder 602 and its internal variables 605. The output of the VAD 604 is a binary VAD flag 606 which is equal to one when speech is present, and which is equal to zero when speech is not present. The VAD 604 operates on a frame by frame basis, as is specified in, by example, GSM 06.82.

The speech encoder DTX handler 612 continuously passes traffic frames, individually marked by a binary SP flag 607, to the radio subsystem 611. The SP flag 607 indicates to the radio subsystem 611 whether a traffic frame passed by the DTX handler 612 is a speech frame (SP flag="1") or a so-called Silence Descriptor (SID) frame (or Comfort Noise Parameter message) SP flag="0"). The radio subsystem 611 controls the scheduling of the frames for transmission on the air interface, based on the state of the SP flag 607.

A fundamental problem associated with the foregoing use of DTX is that the background acoustic noise, which is transmitted together with the speech, may disappear when the transmission over the air interface is terminated, resulting in discontinuities of the background noise on the RX side. Since the DTX switching can occur rapidly, it has been found that this effect can be objectionable to the listener. This is particularly true in environments with a high background noise level, such as a vehicle. At worst, this effect may result in the speech becoming unintelligible.

A presently preferred solution to this problem is to generate, on the RX side, synthetic noise (i.e., comfort noise) similar to the TX side background noise when the transmission is terminated. As was described above, the required parameters for comfort noise generation are evaluated in the speech encoder on the TX side (block 608 in FIG. 6) and are transmitted to the RX side in SID frames before the radio transmission is switched off, and at a repetitive low rate thereafter. This allows the comfort noise generated during speech inactivity on the RX side to adapt to the changes of the background noise on the TX side.

It has been found that comfort noise of good subjective quality can be generated on the RX side if the comfort noise parameters evaluated on the TX side appropriately represent the level and the spectral envelope of the acoustic background noise. These characteristics of background noise often vary slightly with time, and therefore in order to obtain a good representation, the parameters of the speech encoder describing the level and the spectral envelope of the background noise need to be averaged over a few speech frames. In the DTX systems of the GSM full rate and enhanced full rate speech coders (see GSM 06.31 and GSM 06.81), the length of the SID averaging period is four speech frames and eight speech frames, of 20 milliseconds duration, respectively.

In order to evaluate and transmit the first SID frame containing comfort noise parameters to the RX side at the end of a speech burst, before the transmission is switched off, the above-mentioned hangover period is introduced. The hangover period is a period during which speech inactivity has been detected by the VAD 604 (i.e., VAD flag 606="0"), but the transmission of speech frames has not yet been switched off (i.e., SP flag 607="1"). Reference in this regard may also be had to FIG. 7. During the hangover period, since the VAD 604 has detected speech inactivity, it is guaranteed that the speech frames contain only noise (and not speech), and thus these hangover frames can be used for the averaging of speech encoder parameters to evaluate the comfort noise parameters.

Figure 7:
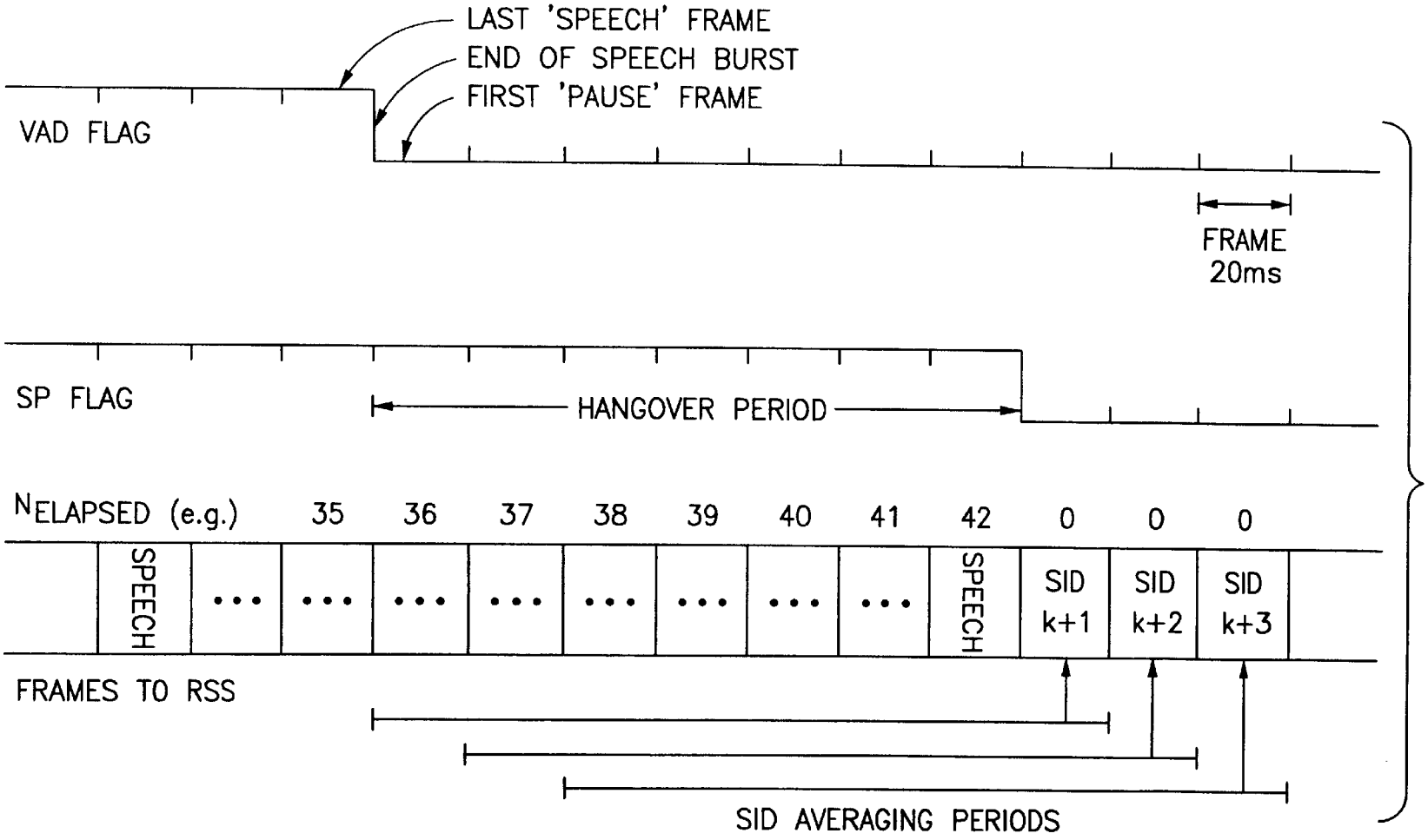
FIG.7 PRIOR ART
FIGS. 7 and 8 are timing diagrams that illustrate the output of the conventional speech encoder of FIG. 6.

The length of the hangover period is determined by the length of the SID averaging period, i.e., the length of the hangover period must be long enough to complete the averaging of the parameters before the resulting comfort noise parameters are to be transmitted in a SID frame. In the DTX system of the GSM full rate speech coder, the length of the hangover period equals four frames (the length of the SID averaging period), since the comfort noise evaluation technique uses only parameters from the previous frames to make an updated SID frame available. In the DTX system of the GSM enhanced full rate speech coder, the length of the hangover period equals seven frames (the length of the SID averaging period minus one), since the parameters of the eighth frame of the SID averaging period can be obtained from the speech encoder while processing the first SID frame. FIG. 7 illustrates the concepts of the hangover period and the SID averaging periods in the DTX system of the GSM enhanced full rate speech coder.

At the end of the hangover period the first SID frame is transmitted, and the comfort noise evaluation algorithm continues evaluating the characteristics of the background noise and passes the updated SID frames to the radio subsystem 611 frame by frame, as long as the VAD 604 continues to detect speech inactivity. The TX DTX handler 612 informs the comfort noise evaluation algorithm 608 of the completion of a SID averaging period using a flag 609. The flag 609 is normally reset to "0", and is raised to a "1" whenever an updated SID frame is to be passed to the radio subsystem 611. When the flag 609 is raised, the comfort noise evaluation algorithm 608 performs the averaging of parameters to make an updated SID frame available for the radio subsystem 611. The updated SID frames are sent to the radio subsystem 611, as well as written to a SID memory block 610, which stores the most recent SID frame for later use.

If, at the end of the speech burst, less than 24 frames have elapsed since the last SID frame was computed and passed to the radio subsystem, then the last SID frame is repeatedly fetched from the SID memory 610 and passed to the radio subsystem 611. This occurs until a new updated SID frame is available, i.e., this process continues until the SID averaging period is again completed. This technique reduces the transmission activity in cases when short background noise spikes are interpreted as speech, since there is no need to insert the hangover period at the end of the speech burst to be able to compute a new SID frame.

Figure 8:
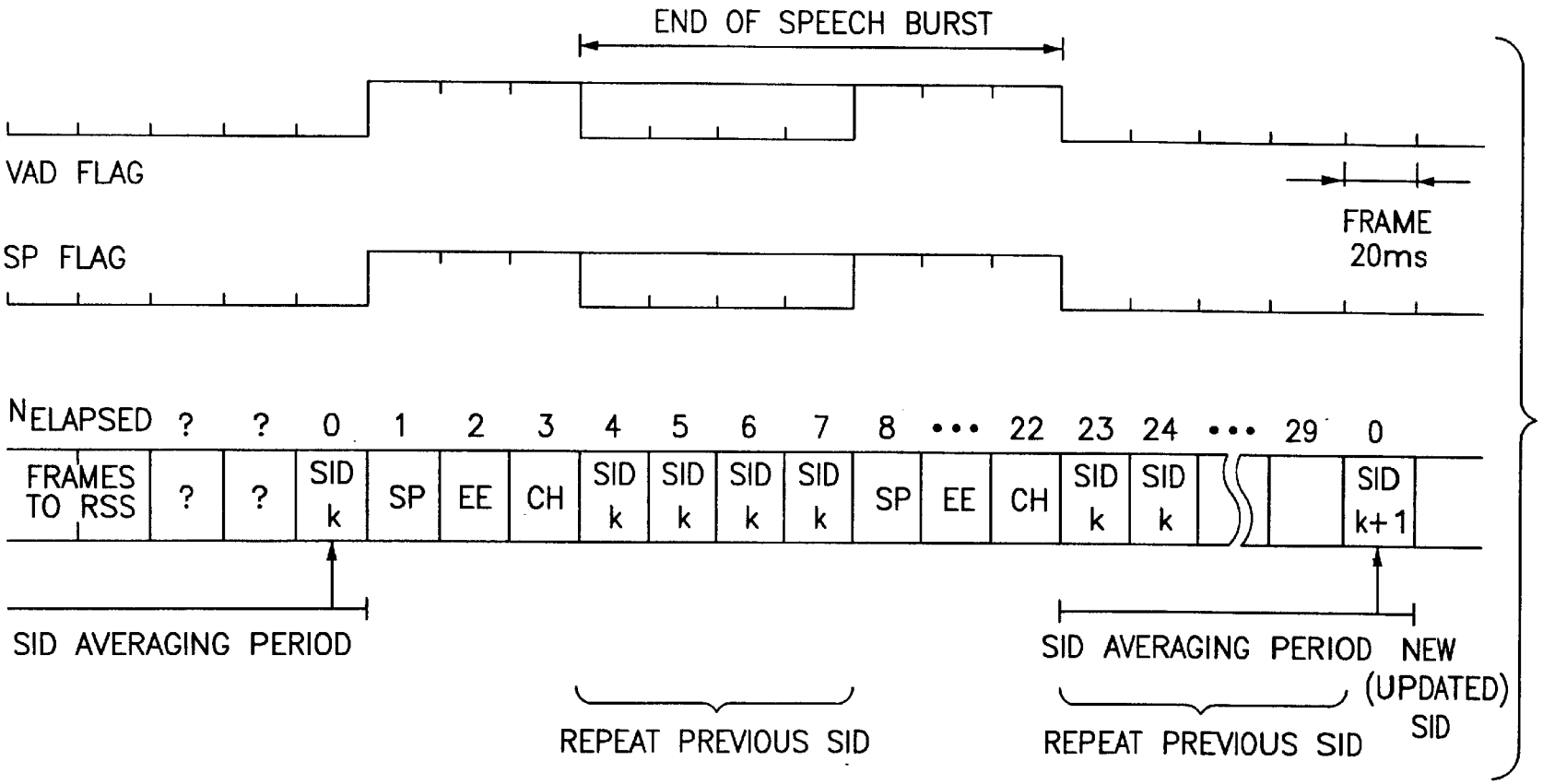
FIG.8 PRIOR ART

FIG. 8 shows as an example the longest possible speech burst without hangover. The binary flag 613 is used for signalling the SID memory 610 when to store the new, updated SID frame in the SID memory 610, and when to send the most recent updated SID frame from the SID memory 610 to the radio subsystem 611. The SID memory 610 determines whether to store or send the SID frame during each frame when the SP flag 607 is a "0".

The binary flag 614 is also needed, in the DTX system of the GSM enhanced full rate speech coder, to inform the noise evaluation algorithm about the end of the hangover period. The flag 614 is normally reset to "0", and is raised to a "1" for the duration of one frame when the first SID frame after a speech burst is to be sent, if preceded by the hangover period.

Figure 9:
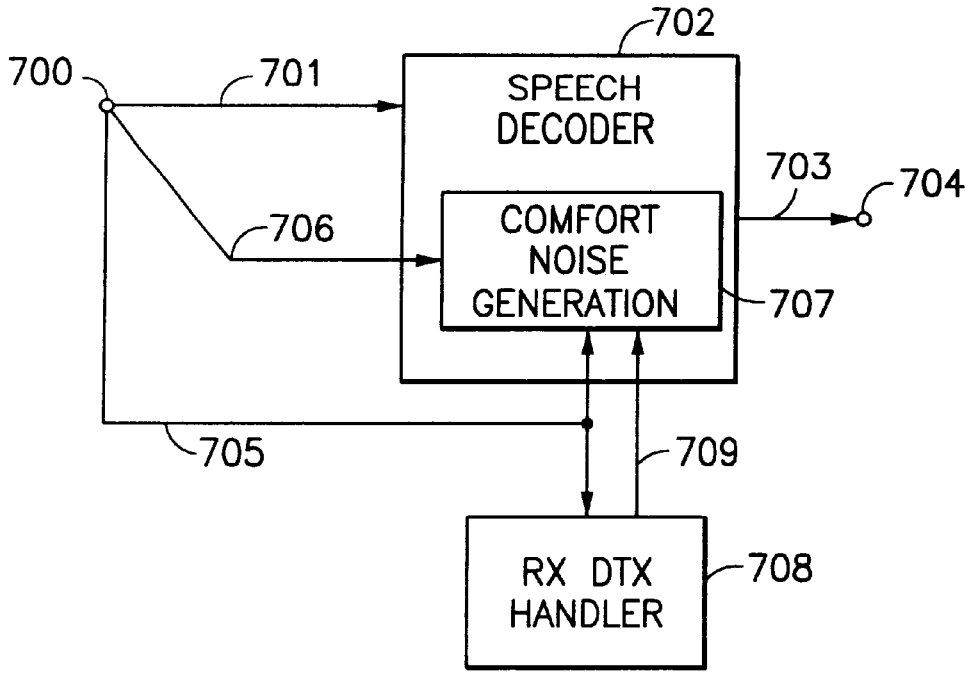
FIG.9 PRIOR ART
FIG. 9 is block diagram of a conventional speech decoder, all of which are useful in explaining the speech decoder shown in FIG. 10, which illustrates a further embodiment of this invention.

FIG. 9 is a block diagram of the speech decoder of the receive (RX) side of the DTX system. The incoming set of speech coder parameters 701 from the radio subsystem 700 of the digital mobile radio unit is processed frame by frame in the speech decoder 702 to synthesize a speech signal 703 which is provided to a digital-to-analog converter 704. The digital-to-analog converter 704 generates an audio signal for the listening user.

The RX DTX system receives from the radio subsystem the binary SP flag 705, which mirrors the operation of the SP flag of the TX side, i.e., the SP flag="1" when a speech frame is received, and SP flag="0" when either a SID frame is received, or the transmission is terminated. The binary flag 706, also received from the radio subsystem 700, informs the comfort noise generation algorithm 707 of the existence of a new received SID frame, i.e, the flag is normally reset to "0", and is raised to a "1" whenever the SP flag 705 is "0" and a new SID frame is received.

When the SP flag 705="0", i.e., the discontinuous transmission is active, the comfort noise generation block 707 of the speech decoder 702 generates comfort noise based on the representation of the characteristics of the background noise on the TX side, as received in the SID frames. Updated SID frames are received at a repetitive low rate during discontinuous transmission, and the decoded comfort noise parameters are interpolated between the update SID frames to provide smooth transitions in the characteristics of the comfort noise.

In the DTX system of the GSM full rate speech encoder, whenever a new, updated SID frame is to be computed and sent to the radio subsystem 611 (FIG. 6), the parameters describing the characteristics (the level and the spectrum) of the background noise are averaged over the SID averaging period and scalarly quantized, using the same quantizing schemes as used for quantizing in the normal speech encoding mode. Likewise, when a SID frame arrives in the GSM full rate speech decoder 702, the silence descriptor parameters are decoded using the same dequantization schemes as used in the normal speech decoding mode (e.g., see GSM 06.12).

In the DTX system of the GSM enhanced full rate speech encoder, the parameters describing the spectrum of the background noise (the LSP parameters) are averaged over the SID averaging period when a new SID frame is to be computed, and vector quantized using predictive quantization tables which are also used for quantization of these parameters in the normal speech encoding mode. In the decoder 702 these spectral parameters are dequantized using the same predictive dequantization tables as used in the normal speech decoding mode. The parameters describing the level of the background noise (the fixed codebook gain) are averaged over the SID averaging period when a new SID frame is to be computed, and quantized using the scalar predictive quantization table which is also used for quantization of these parameters in the normal speech encoding mode. In the decoder, these gain parameters are dequantized using the same predictive dequantization table as used in ordinary speech decoding mode (see GSM 06.62).

However, the adaptivity of the predictive quantizers makes it difficult to employ this type of a quantization scheme for quantizing comfort noise parameters to be sent in SID frames. Since the transmission is terminated during speech inactivity, there is no way to maintain the predictors in the quantizer and the dequantizer of the encoder and decoder, respectively, synchronized on a frame-by-frame basis. However, the predictor values for the quantizers can be evaluated locally in the encoder and decoder in the same way as follows. The quantized LSP and fixed codebook gain parameters of the seven most recent speech frames are stored locally both in the encoder 602 and decoder 702. When the hangover period at the end of a speech burst has ended, these stored parameters are averaged. The obtained averaged parameters, which are the reference LSP parameter vector $f^{ref}$ and the reference fixed codebook gain $g_c^{ref}$, then have the same values both in the encoder 602 and in the decoder 702 since, due to quantization, the same quantized LSP and fixed codebook gain values are available in the both during the normal speech encoding mode (assuming an error free transmission). The averaged values of the reference LSP parameter vector $f^{ref}$ and the reference fixed codebook gain $g_c^{ref}$ are then frozen until the next time the hangover period occurs after a speech burst, and used instead of the normal predictors in the quantization algorithms for quantization of the comfort noise parameters.

Referring once more to FIG. 9, a RX DTX handler 708 receives the SP flag 705 as input, and outputs the binary flag 709, which is normally reset to "0", and which is set to "1" for the duration of one frame when the hangover period has occurred after a speech burst. The flag 709 is required in the DTX system of the GSM enhanced full rate speech decoder 702 to inform the comfort noise generation algorithm 707 when to perform averaging to update the reference LSP parameter vector $f^{ref}$ and the reference fixed codebook gain $g_c^{ref}$ (see GSM 06.62). A method for determining the value of flag 709 is described in an earlier filed Finnish patent application FI953252, and in corresponding U.S. Patent Application Ser. No. 08/672,932, filed Jun. 28, 1996, and in PCT application "PCT/FI96/00369", the disclosure of which is incorporated by reference herein in its entirety.

In summary, in many modern speech coders the speech coding parameters are quantized using predictive methods. This implies that in the quantizer, an attempt is made to predict the value to be quantized as closely as possible. In these types of predictive quantizers, the difference or the quotient between the actual parameter value and the predicted parameter value is typically quantized and sent to the receive side. On the receive side, the corresponding dequantizer has a similar predictor as the quantizer. As such, the parameter value quantized on the TX side can be reproduced by adding or multiplying the received difference or quotient value, respectively, with the predicted value.

In such predictive quantizers, the predictor is typically made adaptive so that the result of the quantization is used to update the predictor after each quantization. The predictors of the quantizer and the dequantizer are both updated using the reproduced, quantized parameter value, in order to keep the predictors synchronized.

The adaptivity of the predictive quantizers makes it difficult to employ the type of quantization scheme for quantizing comfort noise parameters that are sent in SID frames. Since the transmission is terminated during speech inactivity, there is no way to keep the predictors in the quantizer and the dequantizer of the encoder 602 and decoder 702 synchronized on a frame-by-frame basis.

It would, however, be desirable to be able to employ the same quantizing tables, for quantization of comfort noise parameters, as are used by the predictive quantizers in the ordinary speech encoding mode. This would require the prediction to be performed in a non-adaptive fashion during the discontinuous transmission. The predictors should have values as close to the average parameter values of the present background noise as possible, in order for the quantizers to be able to encode the fluctuations in the parameter values due to changes in the characteristics of the background noise. The same predicted values should, preferably, be available in the quantizer and in the dequantizer.

As was indicated previously, one technique to obtain good predicted values for quantizing the comfort noise to be sent in SID frames is to store the quantized parameter values in the normal speech encoding mode during the hangover period, and to compute an average of the stored, quantized parameter values at the end of the hangover period. The averaged predictor values are then frozen until the next hangover period occurs. However, a problem with this method is that the speech decoder 702, in those DTX techniques that are similar to that of GSM, does not know when a hangover period exists at the end of a speech burst.

An aspect of this invention is thus to provide a technique to inform the speech decoder 702 of the existence of a hangover period at the end of a speech burst. This is accomplished, preferably, by sending the hangover period information as side information in the SID frame (or comfort noise parameter message) from the speech encoder 602 to the speech decoder 702.

Figure 10:
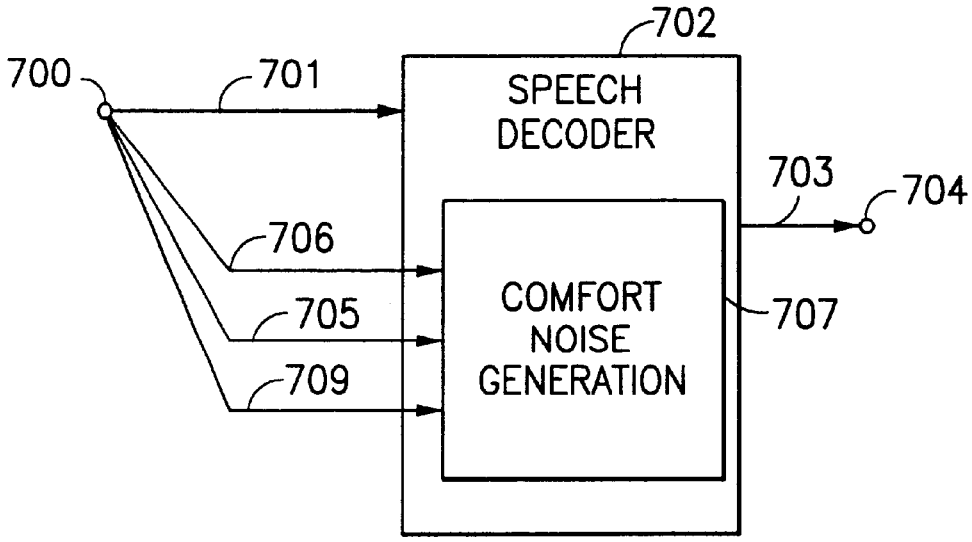
Figure 11A:
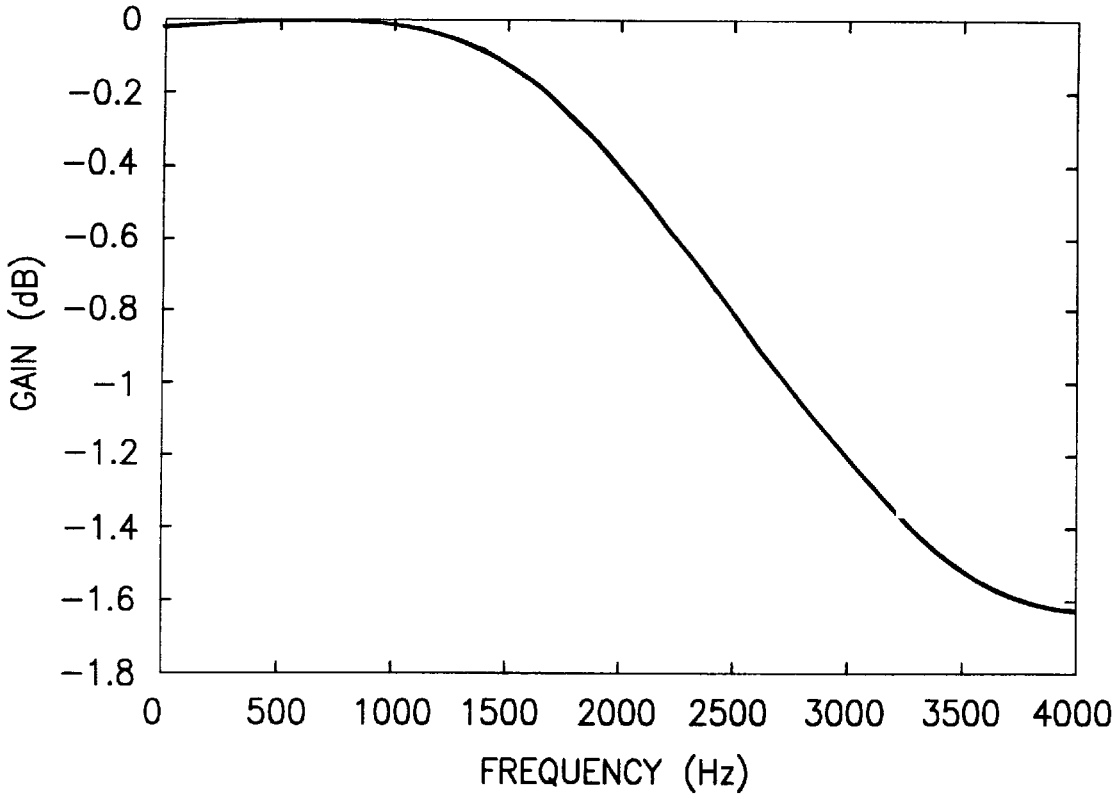
FIGS. 11*a*–11*g* illustrate exemplary frequency responses of the RESC filter.
Figure 11B:
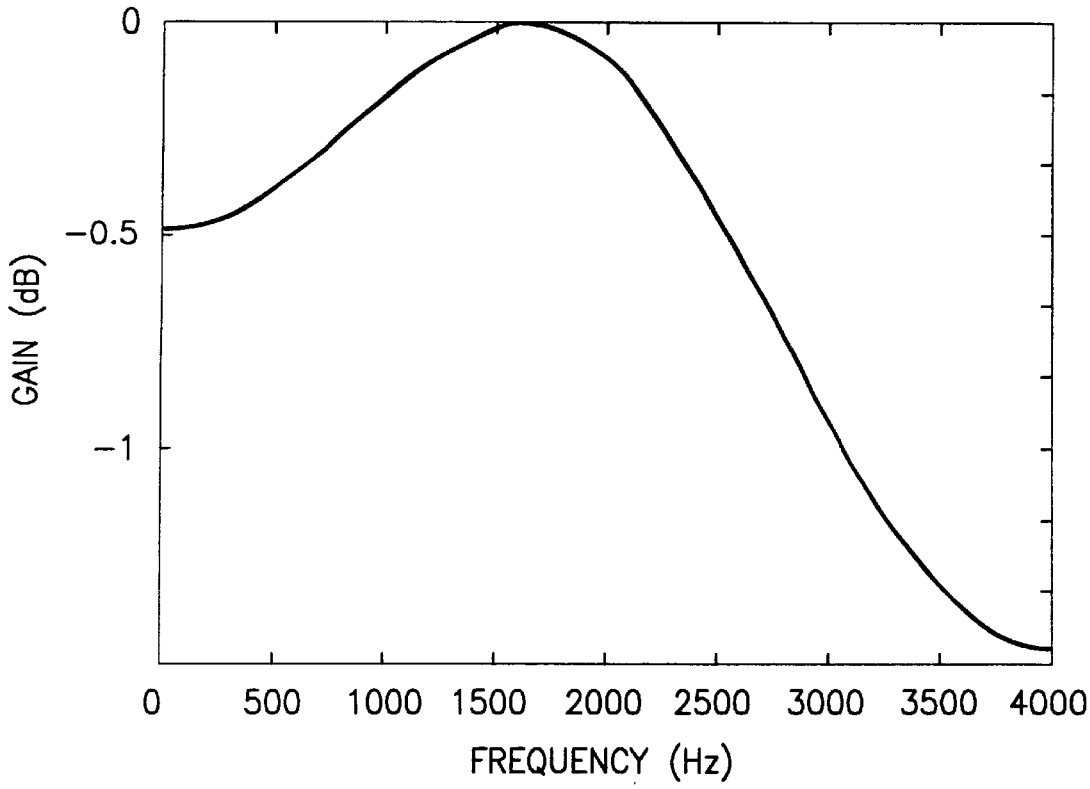
Figure 11C:
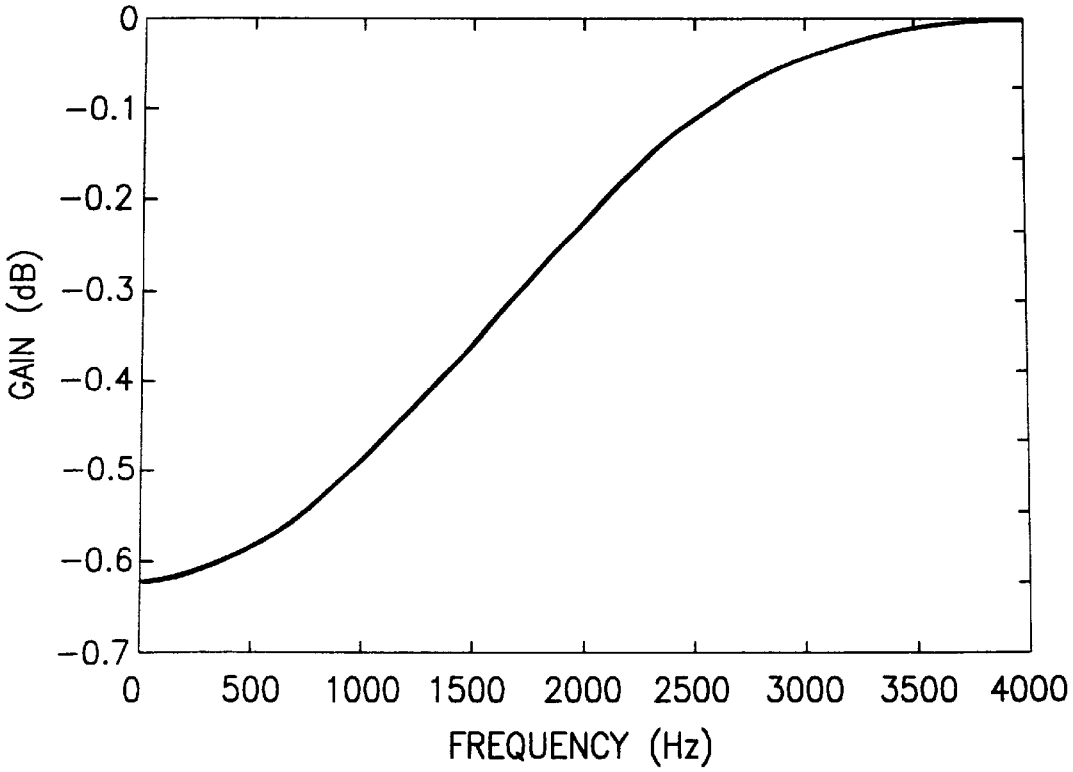
Figure 11D:
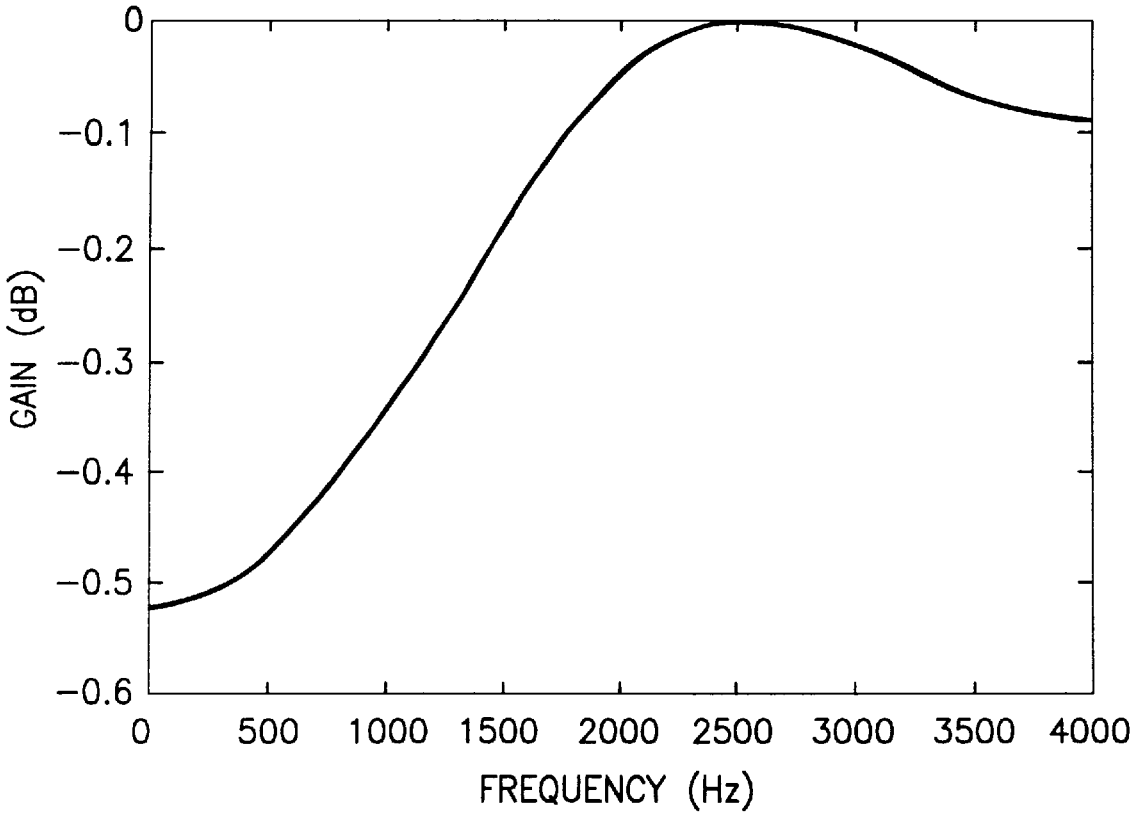
Figure 11E:
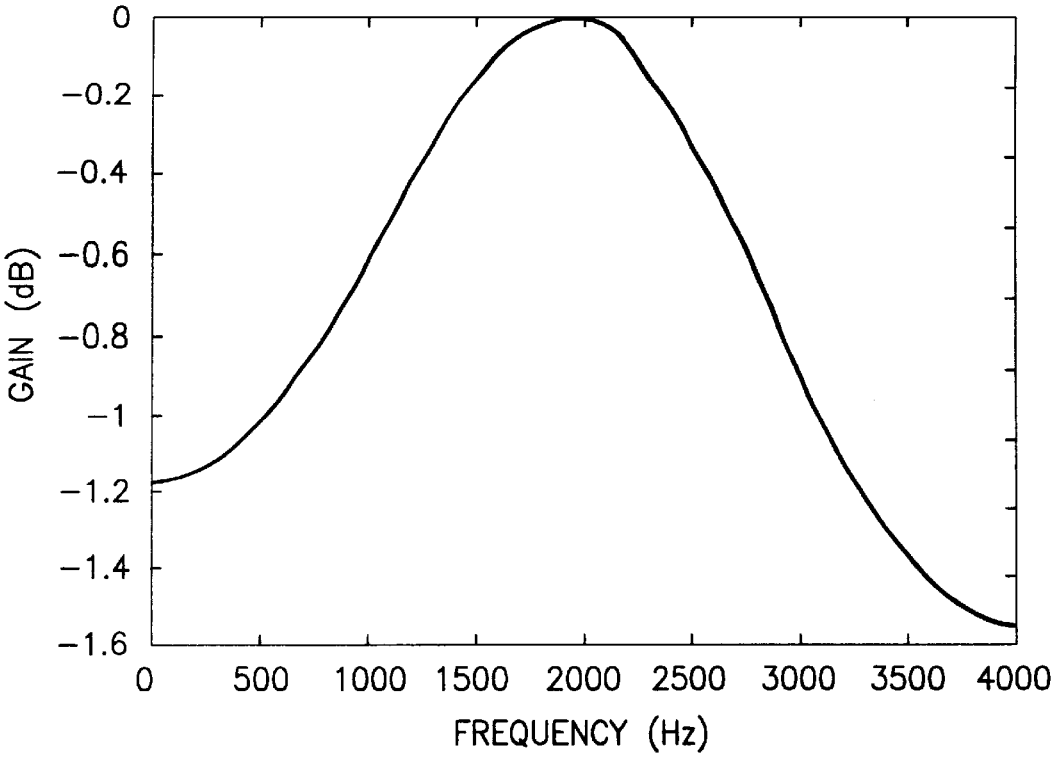
Figure 11F:
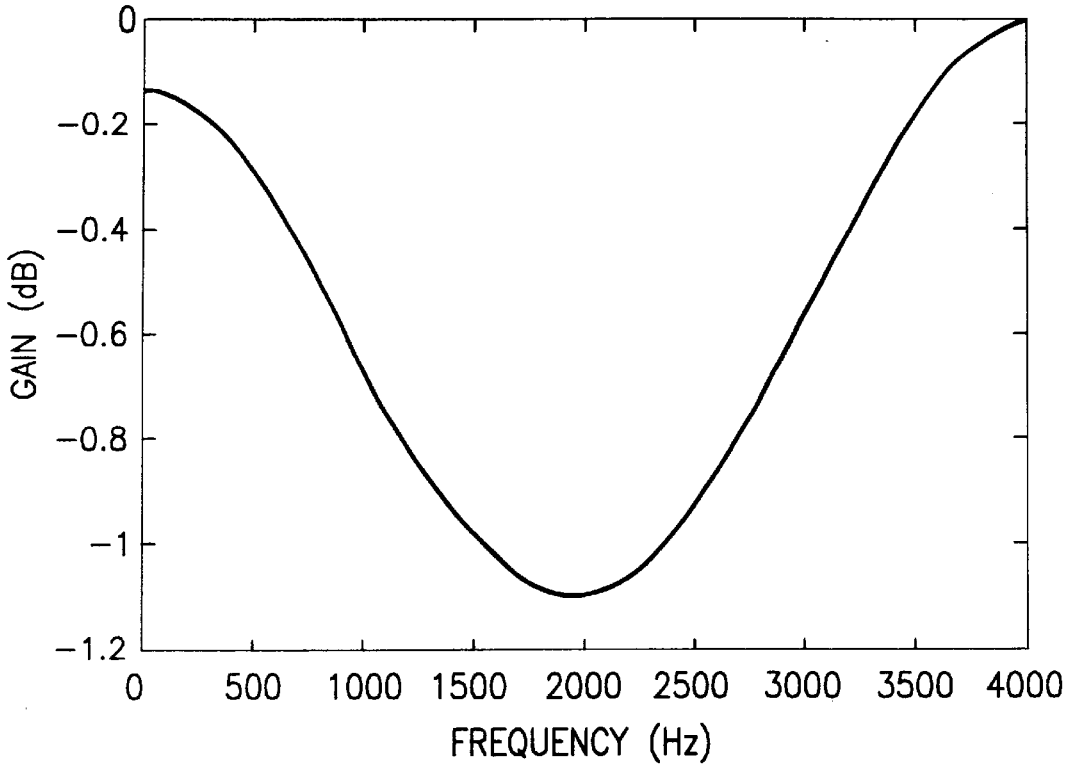
Figure 11G:
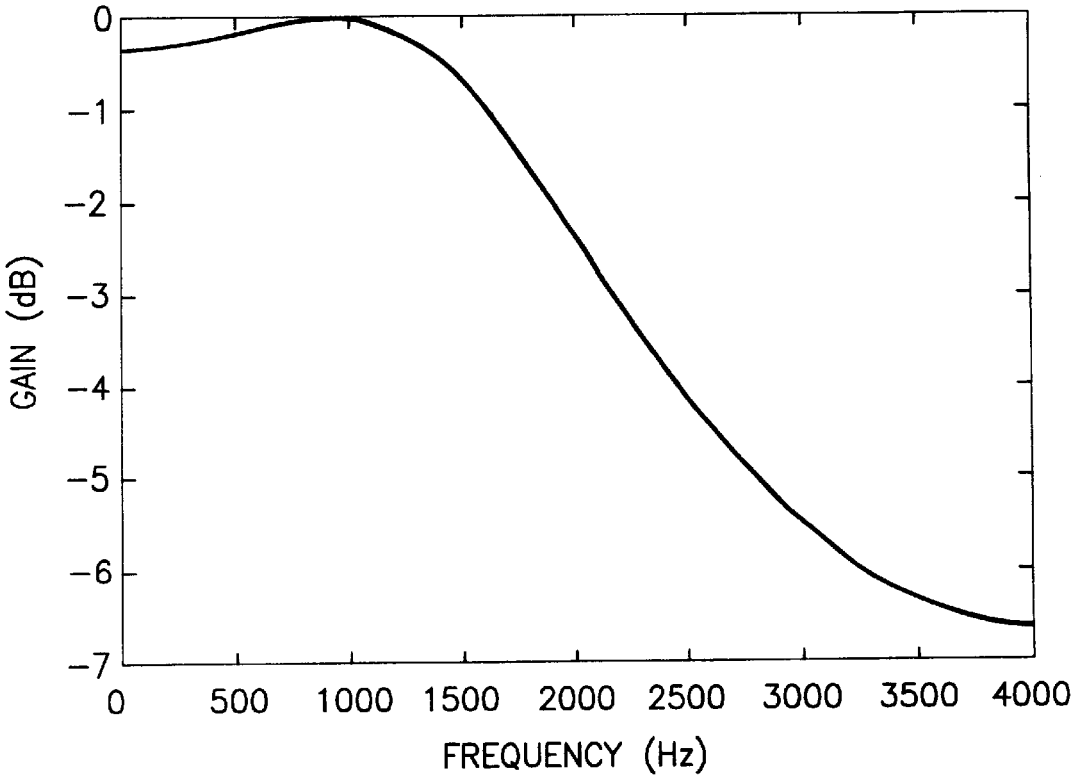

To illustrate the method according to this aspect of the invention, reference is made to FIG. 10. In FIG. 10 the binary flag 709 is no longer generated by the RX DTX handler, but instead is transmitted from the encoder 602 and is received from the transmission channel in the first SID frame. The RX DTX handler block 708 is thus no longer required for the purposes of dequantization using the predictive methods described in this invention, since the flag 709 is not required to be generated locally at the decoder 702. In accordance with this aspect of the invention, the flag 709 is raised to a "1" in the first SID frame, if the first SID frame is preceded by a hangover period. If the first SID frame is not preceded by a hangover period, the flag 709 in the first SID frame is reset to "0". In the second and further SID frames of the comfort noise insertion period, the flag 709 is always reset to "0".

An advantage of this aspect of the invention is that there is no need for the speech decoder DTX handler 708 to determine locally the existence of the hangover period at the end of the speech burst. This eliminates a portion of the computational load from the speech decoder 702, and reduces the number of program instructions used by the RX DTX handler 708.

A further advantage, related to providing the decoder 702 the information concerning the existence of the hangover period, is that it now becomes possible to re-initialize the pseudonoise excitation generators synchronously at the encoder 602 and the decoder 702 each time a hangover period ends.

Another advantage related to providing the decoder 702 the information concerning the existence of the hangover period is that the interpolation of the received comfort noise parameters can be performed in different ways, depending on whether or not the hangover period is present at the end of a speech burst, in order to reduce the perceived step-like changes in the level or spectrum of comfort noise when short speech bursts occur.

Figure 12:
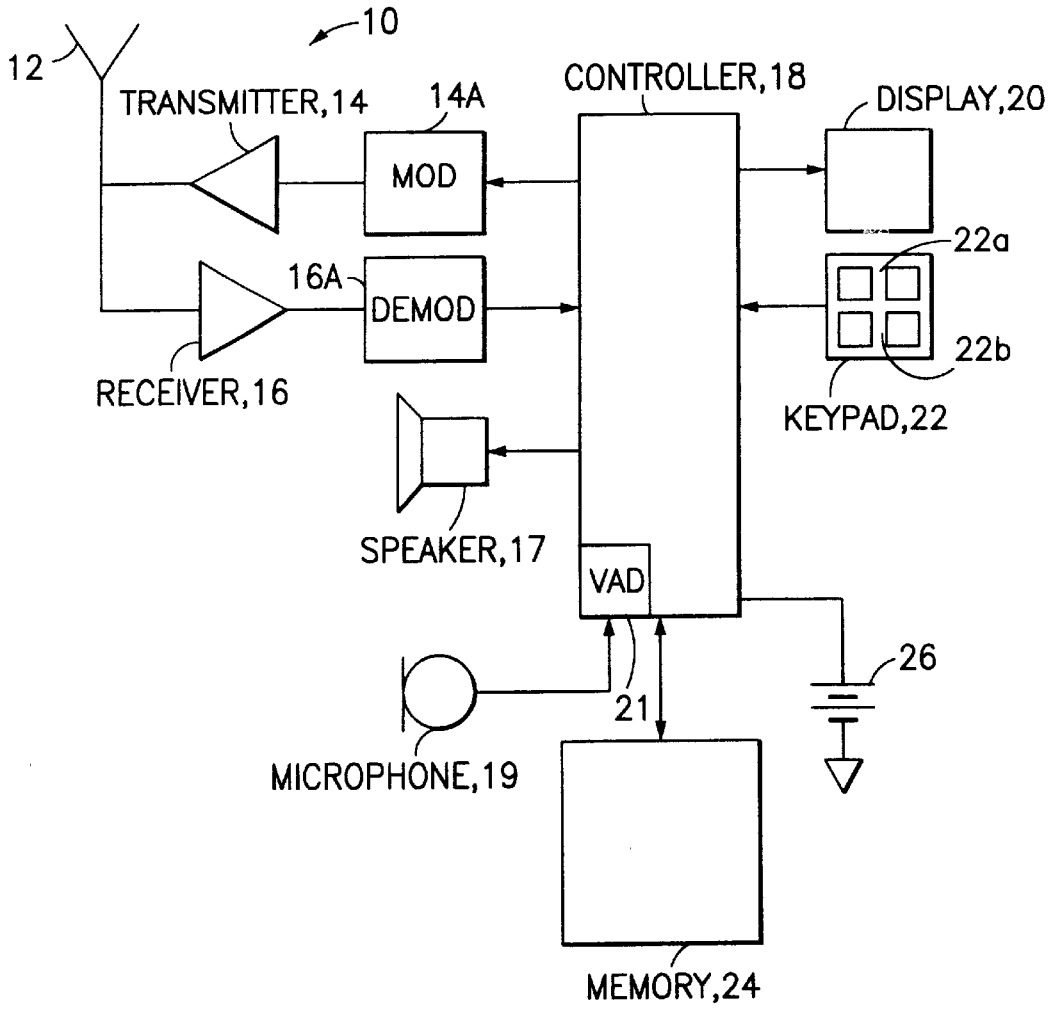
Figure 13:
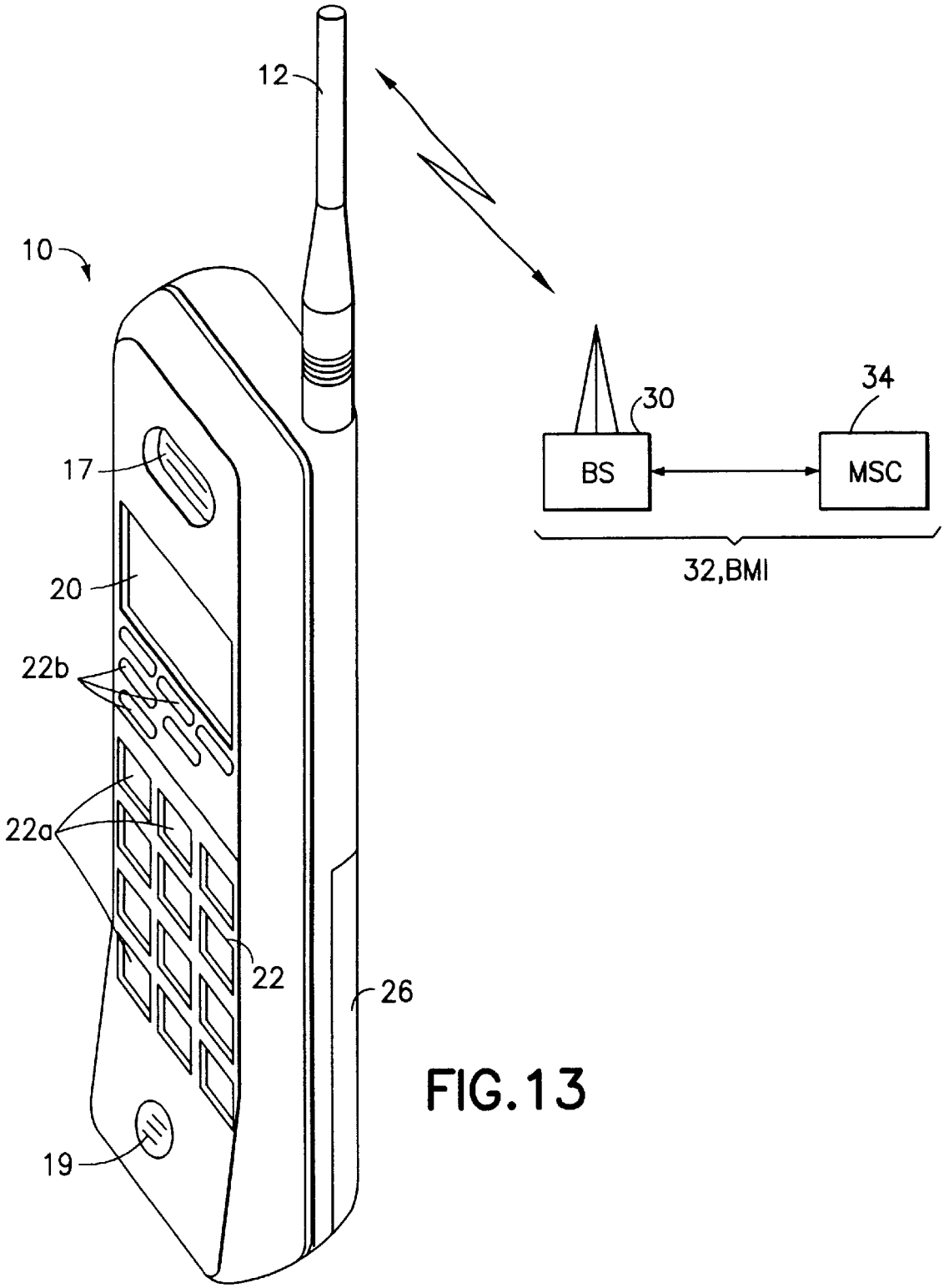
FIG. 13 illustrates the mobile terminal coupled to a base station of a wireless communications system that is also suitable for practicing this invention.

Before further describing the operation of this invention in detail, reference is made to FIGS. 12 and 13 for illustrating a wireless user terminal or mobile station 10, such as but not limited to a cellular radiotelephone or a personal communicator, that is suitable for practicing this invention. The mobile station 10 includes an antenna 12 for transmitting signals to and for receiving signals from a base site or base station 30. The base station 30 is a part of a cellular network that may include a Base Station/Mobile Switching Center/Interworking function (BMI) 32 that includes a mobile switching center (MSC) 34. The MSC 34 provides a connection to landline trunks when the mobile station 10 is involved in a call. In the context of this disclosure the mobile station 10 may be referred to as the transmission side and the base station as the receive side. The base station 30 is assumed to include suitable receivers and speech decoders for receiving and processing encoded speech parameters and also DTX comfort noise parameters, as described below.

The mobile station includes a modulator (MOD) 14A, a transmitter 14, a receiver 16, a demodulator (DEMOD) 16A, and a controller 18 that provides signals to and receives signals from the transmitter 14 and receiver 16, respectively. These signals include signalling information in accordance with the air interface standard of the applicable cellular system, and also user speech and/or user generated data. The air interface standard is assumed for this invention to include a physical and logical frame structure, although the teaching of this invention is not intended to be limited to any specific structure, or for use only with an IS-136 or similar compatible mobile station, or for use only in TDMA type systems. The air interface standard is also assumed to support a DTX mode of operation.

It is understood that the controller 18 also includes the circuitry required for implementing the audio and logic functions of the mobile station. By example, the controller 18 may be comprised of a digital signal processor device, a microprocessor device, and various analog to digital converters, digital to analog converters, and other support circuits. The control and signal processing functions of the mobile station are allocated between these devices according to their respective capabilities. The controller 18 is assumed for the purposes of this disclosure to include the necessary speech coder and other functions for implementing the improved comfort noise generation and DTX methods and apparatus of this invention. These functions can be implemented wholly in software, wholly in hardware, or in a mixture of hardware and software.

A user interface includes a conventional earphone or speaker 17, a speech transducer such as a conventional microphone 19 in combination with an A/D converter and a speech encoder, a display 20, and a user input device, typically a keypad 22, all of which are coupled to the controller 18. The keypad 22 includes the conventional numeric (0–9) and related keys (#,*) 22*a*, and other keys 22*b* used for operating the mobile station 10. These other keys 22*b* may include, by example, a SEND key, various menu scrolling and soft keys, and a PWR key. The mobile station 10 also includes a battery 26 for powering the various circuits that are required to operate the mobile station.

The mobile station 10 also includes various memories, shown collectively as the memory 24, wherein are stored a plurality of constants and variables that are used by the controller 18 during the operation of the mobile station. For example, the memory 24 stores the values of various cellular system parameters and the number assignment module (NAM). An operating program for controlling the operation of controller 18 is also stored in the memory 24 (typically in a ROM device). The memory 24 may also store data, including user messages, that is received from the BMI 32 prior to the display of the messages to the user. The memory 24 also includes routines for implementing the methods described below with regard to the transmission of comfort noise parameters during DTX operation.

It should be understood that the mobile station 10 can be a vehicle mounted or a handheld device. It should further be appreciated that the mobile station 10 can be capable of operating with one or more air interface standards, modulation types, and access types. By example, the mobile station may be capable of operating with any of a number of other standards besides IS-136, such as GSM. It should thus be clear that the teaching of this invention is not to be construed to be limited to any one particular type of mobile station or air interface standard.

Although the invention is described next specifically in the context of an IS-136 embodiment, it is again noted that the teaching of this invention is not limited to only this one air interface standard.

With regard to DTX on a digital traffic channel (IS-136.1, Rev. A, Section 2.3.11.2), when in the DTX-High state the transmitter 14 radiates at a power level indicated by the most recent power-controlling order (Initial Traffic Channel Designation message, Digital Traffic Channel (DTC) Designation message, Handoff message, Dedicated DTC Handoff message, or Physical Layer Control message) received by the mobile station 10.

In the DTX-Low state, the transmitter 14 remains off. The CDVCC is not sent except for the transmission of Fast Associated Control Channel (FACCH) messages. All Slow Associated Control Channel (SACCH) messages to be transmitted by the mobile station 10, while in the DTX-Low state, are sent as a FACCH message, after which the transmitter 14 returns again to the off state unless Discontinuous Transmission (DTX) has been otherwise inhibited.

When the mobile station 10 desires to switch from the DTX-High state to the DTX-Low state, it may complete all in-progress SACCH messages in the DTX-High state, or terminate SACCH message transmission and resend the interrupted SACCH messages, in their entirety, as FACCH messages in the DTX-Low state.

When a mobile station switches from the DTX High state to the DTX Low state, it must pass through a transition state in which the transmitted power is at the DTX High level until all pending FACCH messages have been entirely transmitted.

In the preferred embodiment of this invention the mobile station 10 remains in the transition state until a Comfort Noise Block (comprised of six DTX hangover slots, and the related Comfort Noise Parameter message) have been entirely transmitted. The Comfort Noise Block is sent without interruption. If some other FACCH message slots coincide with the sending of the Comfort Noise Block, the mobile station 10 delays the transmission of either the FACCH message or the Comfort Noise Block so as to transmit one before the other, but in any case the FACCH messages are effectively grouped or segregated such that they do not interrupt or steal the slots used for the transmission of the Comfort Noise Block. This insures the best available quality of comfort noise that is generated at a base station voice/comfort noise decoder.

Reference in this regard is made to commonly assigned and copending U.S. patent application Ser .No. 08/936,755, filed Sep. 25, 1997, entitled "Transmission of Comfort Noise Parameters During Discontinuous Transmission", by Seppo Alanara and Pekka Kapanen.

In accordance with a specific embodiment, the Comfort Noise (CN) Parameter Message, shown below in Table 1, is transmitted on the reverse digital traffic channel (RDTC), specifically the FACCH logical channel, and contains 38 bits, of which 26 bits contain a LSF residual vector which is quantized using the same split vector quantization (SVQ) codebook as used in the IS-641 speech codec. The quantization/dequantization algorithms of the speech codec are modified to make it possible to use this codebook. The LSF parameters give an estimate of the spectral envelope of the background noise at the transmit side using, preferably, a 10th order LPC model of the spectrum.

The next 8 bits contain a comfort noise energy quantization index, which describes the energy of the background noise at the transmit side. The remaining 4 bits in the message are used for transmitting a Random Excitation Spectral Control (RESC) information element.

TABLE 1

Message Format

| Information Element | Type | Length (bits) |
|---|---|---|
| Protocol Discriminator | M | 2 |
| Message Type | M | 8 |
| LSF residual vector | M | 26 |
| CN energy quantization index | M | 8 |
| RESC parameters | M | 4 |

To summarize, the problems discussed in the Background section of this patent application are addressed by generating, on the receive side, a synthetic noise similar to the transmit side background noise. The comfort noise (CN) parameters are estimated on the transmit side and transmitted to the receive side before the radio transmission is switched off, and at a regular low rate afterwards. This allows the comfort noise to adapt to the changes of the noise on the transmit side. The DTX mechanism in accordance with this invention employs: a Voice Activity Detector (VAD) function 21 (FIG. 12) on the transmit side; an evaluation in the controller 18 of the background acoustic noise on the transmit side, in order to transmit characteristic parameters to the receive side; and a generation on the receive side of a similar noise, referred to as comfort noise, during periods where the radio transmission is switched off.

In addition to these functions, if the parameters arriving at the receive side are found to be seriously corrupted by errors, the speech or comfort noise is instead generated from substituted data in order to avoid generating annoying audio effects for the listener.

The transmit side DTX function continuously passes traffic frames, each marked by a flag SP, to the radio transmitter 14, where the SP flag="1" indicates a speech frame, and where the SP flag="0" indicates an encoded set of Comfort Noise parameters. The scheduling of the frames for transmission on the air interface is controlled by the radio transmitter 14, on the basis of the SP flag.

Figure 14:
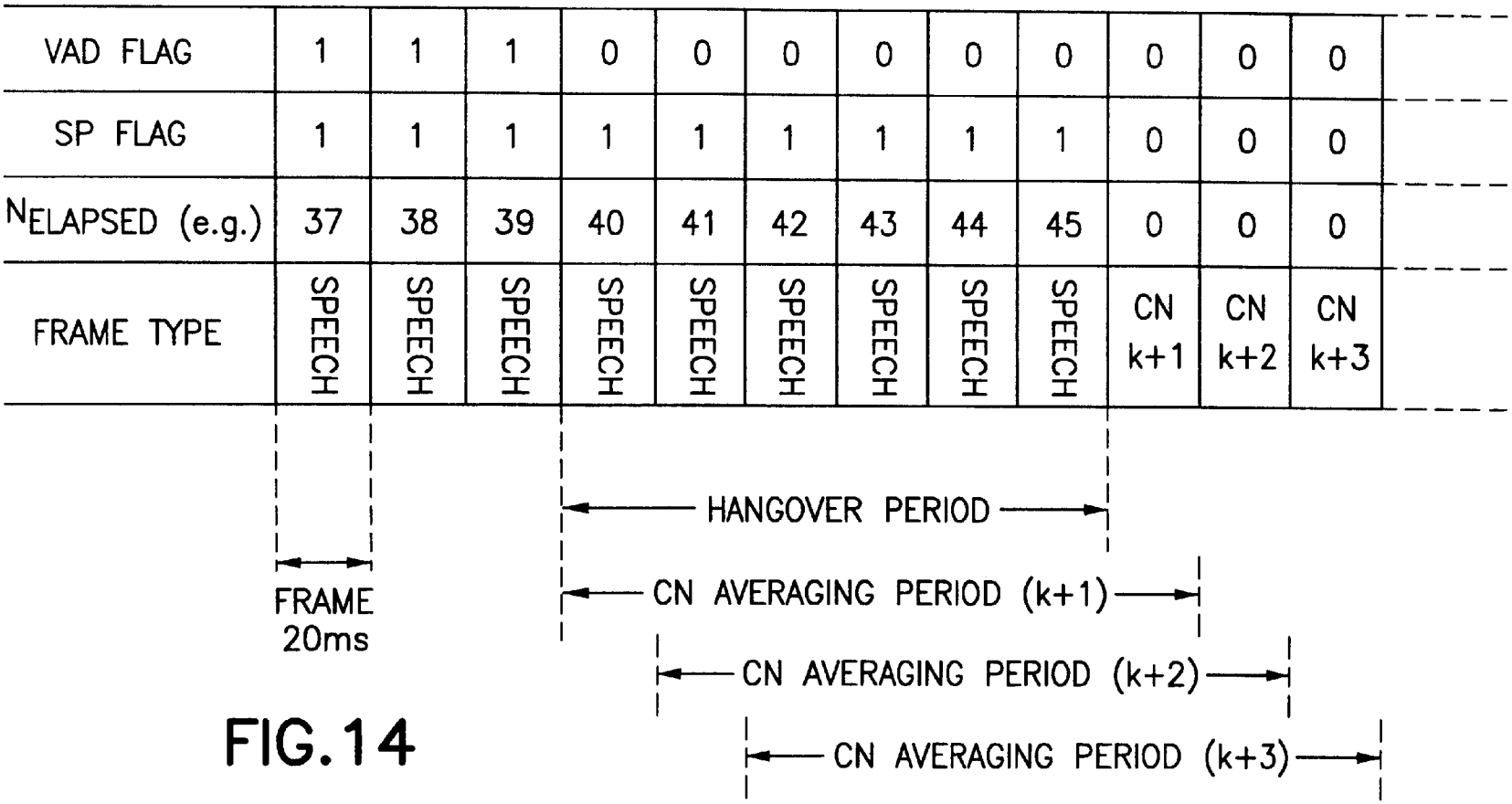
FIG. 14 is a timing diagram illustrating a normal hangover procedure, wherein $N_{elapsed}$ indicates a number of elapsed frames since a last occurrence of updated comfort noise (CN) parameters, and wherein $N_{elasped}$ is equal to or greater than 24.

In a preferred embodiment of this invention, and to allow an exact verification of the transmit side DTX functions, all frames before the reset of the mobile station 10 are treated as if they were speech frames for an infinitely long time. Therefore, the first 6 frames after the reset are always marked with SP flag="1", even if VAD flag="0" (hangover period, see FIG. 14).

The Voice Activity Detector (VAD) 21 operates continuously in order to determine whether the input signal from the microphone 19 contains speech. The output is a binary flag (VAD flag="1" or VAD flag="0", respectively) on a frame by frame basis.

The VAD flag controls indirectly, via the transmit side DTX handler operations described below, the overall DTX operation on the transmit side.

Whenever the VAD flag="1", the speech encoded output frame is passed directly to the radio transmitter 14, marked with the SP flag="1".

At the end of a speech burst (transition VAD flag="1" to VAD flag="0"), it requires seven consecutive frames to make a new updated set of CN parameters available. Normally, the first six speech encoder output frames after the end of the speech burst are passed directly to the radio transmitter 14, marked with the SP flag="1", thereby forming the "hangover period". The first new set of CN parameters is then passed to the radio transmitter 14 as the seventh frame after the end of the speech burst, marked with the SP flag="0" (see FIG. 14).

Figure 15:
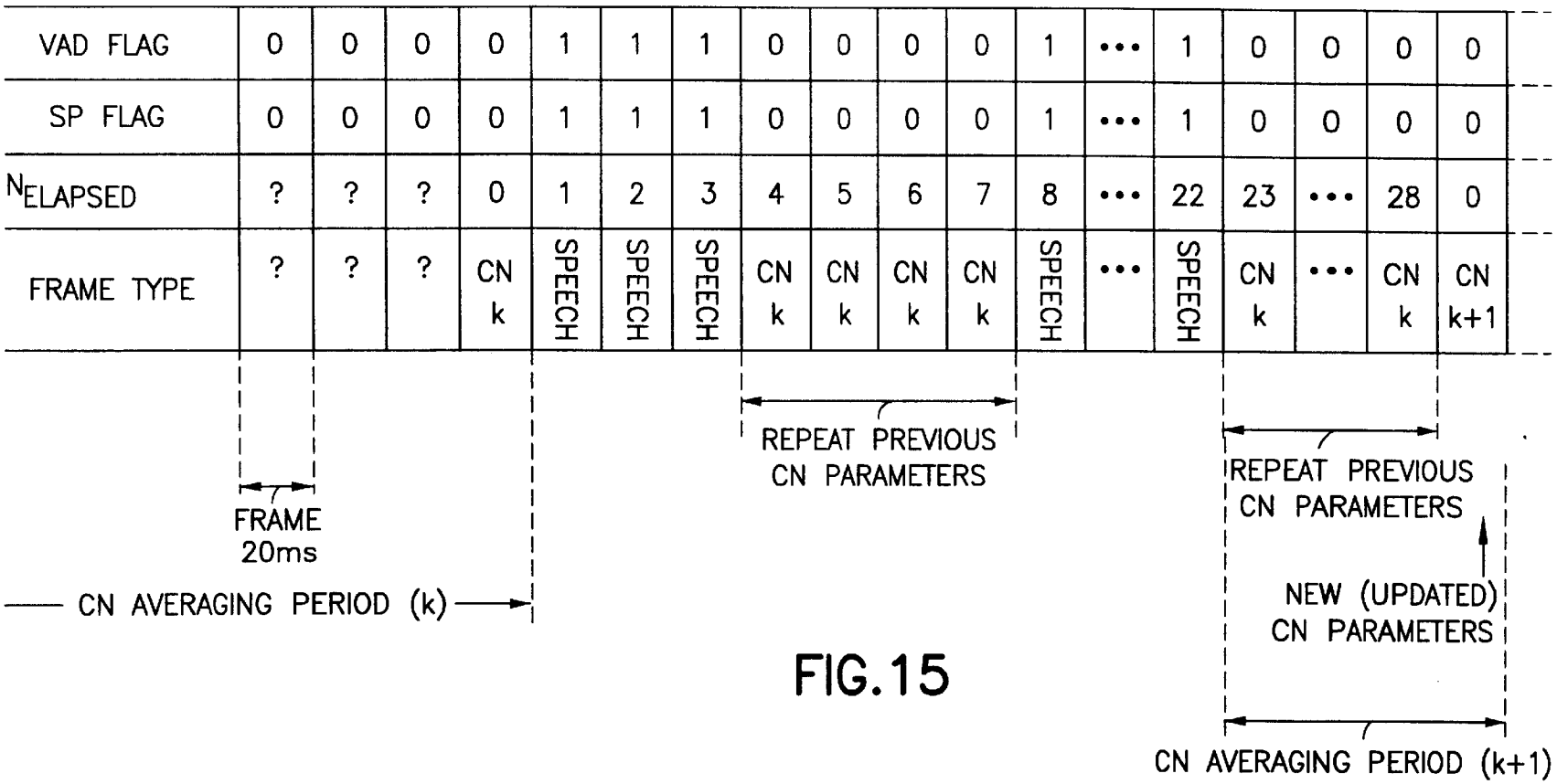
FIG. 15 is a timing diagram illustrating the handling of short speech bursts, wherein $N_{elapsed}$ is less than 24.

If, however, at the end of the speech burst, less than 24 frames have elapsed since the last set of CN parameters were computed and passed to the radio transmitter 14, then the last set of CN parameters are repeatedly passed to the radio transmitter 14, until a new updated set of CN parameters is available (seven consecutive frames marked with VAD flag="0"). This reduces the activity on the air interface in cases where short background noise spikes are interpreted as speech, by avoiding the "hangover" waiting for the CN parameter computation. FIG. 15 shows as an example the longest possible speech burst without hangover.

Once the first set of CN parameters after the end of a speech burst has been computed and passed to the radio transmitter 14, the transmit side DTX handler continuously computes and passes updated sets of CN parameters to the radio transmitter 14, marked with the SP flag="0", so long as the VAD flag="0".

The speech encoder is operated in a normal speech encoding mode if the SP flag="1" and in a simplified mode if the SP flag="0", because not all encoder functions are required for the evaluation of CN parameters.

In the radio transmitter 14 the following traffic frames are scheduled for transmission: all frames marked with the SP flag="1"; the first frame marked with the SP flag="0" after one or more frames with the SP flag="1"; those frames marked with SP="0" and scheduled for transmission of CN parameter update messages.

This has the overall effect of transitioning to the DTX low state after the transmission of a CN parameter message when the speaker stops talking. During speech pauses the transmission is resumed at, for example, regular intervals for transmission of one CN parameter message, in order to update the generated comfort noise on the receive side.

The comfort noise evaluation algorithm uses the unquantized and quantized (e.g.) Linear Prediction (LP) parameters of the speech encoder, using the Line Spectral Pair (LSP) representation, where the unquantized Line Spectral Frequency (LSF) vector is given by $f^t=[f_1\ f_2\ \ldots\ f_{10}]$ and the quantized LSF vector by $\hat{f}^t=[\hat{f}_1\hat{f}_2\ \ldots\ \hat{f}_{10}]$, with t denoting transpose. The algorithm also uses the LP residual signal r(n) of each subframe for computing the random excitation gain and the Random Excitation Spectral Control (RESC) parameters.

The algorithm computes the following parameters to assist in comfort noise generation: the reference LSF parameter vector $\hat{f}^{ref}$ (average of the quantized LSF parameters of the hangover period); the averaged LSF parameter vector $f^{mean}$ (average of the LSF parameters of the seven most recent frames); the averaged random excitation gain $g^{mean}{}_{cn}$ (average of the random excitation gain values of the seven most recent frames); the random excitation gain $g_{cn}$; and the RESC parameters $\Lambda$.

These parameters give information on the spectrum ($f$, $\hat{f}$, $\hat{f}^{ref}$, $f^{mean}$, $\Lambda$) and the level ($g_{cn}$, $g^{mean}{}_{cn}$) of the background noise.

Three of the evaluated comfort noise parameters ($f_{mean}$, $\Lambda$, and $g^{mean}{}_{cn}$) are encoded into a special FACCH message, referred to herein as the Comfort Noise (CN) parameter message, for transmission to the receive side. Since the reference LSF parameter vector $\hat{f}^{ref}$ can be evaluated in the same way in the encoder and decoder, as described below, no transmission of this parameter vector is necessary.

The CN parameter message also serves to initiate the comfort noise generation on the receive side, as a CN parameter message is always sent at the end of a speech burst, i.e., before the radio transmission is terminated.

The scheduling of CN parameter messages or speech frames on the radio path was described above with reference to FIGS. 7 and 8.

The background noise evaluation involves computing three different kinds of averaged parameters: the LSF parameters, the random excitation gain parameter, and the RESC parameters. The comfort noise parameters to be encoded into a Comfort Noise parameter message are calculated over the CN averaging period of N=7 consecutive frames marked with VAD="0", as described in greater detail below.

Prior to averaging the LSF parameters over the CN averaging period, a median replacement is performed on the set of LSF parameters to be averaged, to remove the parameters which are not characteristic of the background noise on the transmit side. First, the spectral distances from each of the LSF parameter vectors f(i) to the other LSF parameter vectors f(j), i =0 . . . 6, j=0 . . . 6, 0≠j, within the CN averaging period are approximated according to the equation:

$$\Delta R_{ij} = \sum_{k=1}^{10} (f_i(k) - f_j(k))^2 \tag{4}$$

where $f_i(k)$ is the kth LSF parameter of the LSF parameter vector f(i) at frame i.

To find the spectral distance $\Delta S_i$ of the LSF parameter vector f(i) to the LSF parameter vectors f(j) of all other frames j=0 . . . 6, j≠i, within the CN averaging period, the sum of the spectral distances $\Delta R_{ij}$ is computed as follows:

$$\Delta S_i = \sum_{j=0, j\neq i}^{6} \Delta R_{ij} \tag{5}$$

for all i=0 . . . 6, i≠j.

The LSF parameter vector f(i) with the smallest spectral distance $\Delta S_i$ of all the LSF parameter vectors within the CN averaging period is considered as the median LSF parameter vector $f_{med}$ of the averaging period, and its spectral distance is denoted as $\Delta S_{med}$. The median LSF parameter vector is considered to contain the best representation of the short-term spectral detail of the background noise of all the LSF parameter vectors within the averaging period. If there are LSF parameter vectors f (j) within the CN averaging period with:

$$\frac{\Delta S_i}{\Delta S_{med}} > TH_{med} \tag{6}$$

where $TH_{med}=2.25$ is the median replacement threshold, then at most two of these LSF parameter vectors (the LSF parameter vectors causing $TH_{med}$ to be exceeded the most) are replaced by the median LSF parameter vector prior to computing the averaged LSF parameter vector $f^{mean}$.

The set of LSF parameter vectors obtained as a result of the median replacement are denoted as f'(n-i), where n is the index of the current frame, and i is the averaging period index (i=0 . . . 6).

When the median replacement is performed at the end of the hangover period (first CN update), all of the LSF parameter vectors f(n-i) of the six previous frames (the hangover period, i=1 . . . 6) have quantized values, while the LSF parameter vector f(n) at the most recent frame n has unquantized values. In the subsequent CN update, the LSF parameter vectors of the CN averaging period in those frames overlapping with the hangover period have quantized values, while the parameter vectors of the more recent frames of the CN averaging period have unquantized values. If the period of the seven most recent frames is non-overlapping with the hangover period, the median replacement of LSF parameters is performed using only unquantized parameter values.

The averaged LSF parameter vector $f^{mean}(n)$ at frame n is computed according to the equation:

$$f^{mean}(n) = \frac{1}{7}\sum_{i=0}^{6} f'(n-i) \tag{7}$$

where f'(n-i) is the LSF parameter vector of one of the seven most recent frames (i=0 . . . 6) after performing the median replacement, i is the averaging period index, and n is the frame index.

The averaged LSF parameter vector $f^{mean}$ (n) at frame n is preferably quantized using the same quantization tables that are also used by the speech coder for the quantization of the non-averaged LSF parameter vectors in the normal speech encoding mode, but the quantization algorithm is modified in order to support the quantization of comfort noise. The LSF prediction residual to be quantized is obtained according to the following equation:

$$r(n)=f^{mean}(n)-\hat{f}^{ref} \tag{8}$$

where $f^{mean}$ (n) is the averaged LSF parameter vector at frame n, $\hat{f}^{ref}$ is the reference LSF parameter vector, r(n) is the computed LSF prediction residual vector at frame n, and n is the frame index.

The computation of the reference LSF parameter vector $\hat{f}^{ref}$ is made on the basis of the quantized LSF parameters $\hat{f}$ by averaging these parameters over the hangover period of six frames according to the following equation:

$$\hat{f}^{ref} = \frac{1}{6}\sum_{i=1}^{6} \hat{f}(n-i) \tag{9}$$

where $\hat{f}$(n-i) is the quantized LSF parameter vector of one of the frames of the hangover period (i=1 . . . 6), i is the hangover period frame index, and n is the frame index. It should be noted that the quantized LSF parameter vectors $\hat{f}$(n-i) used for computing $\hat{f}^{ref}$ are not subjected to median replacement prior to averaging.

For each CN generation period the computation of the reference LSF parameter vector $\hat{f}^{ref}$ is done only once at the end of the hangover period, and for the rest of the CN generation period $\hat{f}^{ref}$ is frozen. The reference LSF parameter vector $\hat{f}^{ref}$ is evaluated in the decoder in the same way as in the encoder, because during the hangover period the same LSF parameter vectors $\hat{f}$ are available at the encoder and decoder. An exception to this are the cases when transmission errors are severe enough to cause the parameters to become unusable, and a frame substitution procedure is activated. In these cases, the modified parameters obtained from the frame substitution procedure are used instead of the received parameters.

The random excitation gain is computed for each subframe, based on the energy of the LP residual signal of the subframe, according to the following equation:

$$g_{cn}(j) = 1.286\sqrt{\frac{\sum_{i=0}^{39} r(l)^2}{10}} \tag{10}$$

where $g_{cn}$ (j) is the computed random excitation gain of subframe j, r(1) is the 1th sample of the LP residual of subframe j, and 1 is the sample index (1=0 . . . 39). The scaling factor of 1.286 is used to make the level of the comfort noise match that of the background noise coded by the speech codec. The use of this particular scaling factor value should not be read as a limitation of the practice of this invention.

The computed energy of the LP residual signal is divided by the value of 10 to yield the energy for one random excitation pulse, since during comfort noise generation the subframe excitation signal (pseudo noise) has 10 non-zero samples, whose amplitudes can take values of +1 or −1.

The computed random excitation gain values are averaged and updated in the first subframe of each frame n marked with SP="0", when an updated set of CN parameters is required, according to the equation:

$$g_{cn}^{mean}(n) = \frac{1}{25}g_{cn}(n)(1) + \frac{1}{6.25}\sum_{i=1}^{6}\left(\frac{1}{4}\sum_{j=1}^{4} g_{cn}(n-i)(j)\right) \tag{11}$$

where $g_{cn}$ (n)(1) is the computed random excitation gain at the first subframe of frame n, $g_{cn}$ (n-i) (j) is the computed random excitation gain at subframe j of one of the past frames (i=1 . . . 6), and n is the frame index. Since the random excitation gain of only the first subframe of the current frame is used in the averaging, it is possible to make the updated set of CN parameters available for transmission after the first subframe of the current frame has been processed.

The averaged random excitation gain is bounded by $g^{mean}{}_{cn} \leqq 4032.0$ and quantized with an 8-bit non-uniform algorithmic quantizer in the logarithmic domain, requiring no storage of a quantization table.

With regard to the computation of RESC parameters, since the LP residual r(n) deviates somewhat from flat spectral characteristics, some loss in comfort noise quality (spectral mismatch between the background noise and the comfort noise) will result when a spectrally flat random excitation is used for synthesizing comfort noise on the receive side. To provide an improved spectral match, a further second order LP analysis is performed for the LP residual signal over the CN averaging period, and the resulting averaged LP coefficients are transmitted to the receive side in the CN parameter message to be used in the comfort noise generation. This method is referred to as the random excitation spectral control (RESC), and the obtained LP coefficients are referred to as the RESC parameters Λ.

The LP residual signals r(n) of each subframe in a frame are concatenated to compute the autocorrelations $r_{res}(k)$, k=0 . . . 2, of the LP residual signal of the 20 ms frame according to the equation:

$$r_{res}(k) = \sum_{n=k}^{159} r(n)r(n-k), \quad k = 0, \ldots, 2 \tag{12}$$

After computing the autocorrelations according to the foregoing equation, the autocorrelations are normalized to obtain the normalized autocorrelations $r'_{res}(k)$.

For the most recent frame of the CN averaging period, the autocorrelations from only the first subframe are used for averaging to make it possible to prepare the updated set of CN parameters for transmission after the first subframe of the current frame has been processed.

The computed normalized autocorrelations are averaged and updated in the first subframe of each frame n marked with SP ="0", when an updated set of CN parameters is required, according to the equation:

$$r_{res}^{mean}(n) = \frac{1}{25} r'_{res}(n)(1) + \frac{1}{6.25} \sum_{i=1}^{6} r'_{res}(n-i) \tag{13}$$

where $r'_{res}(n)(1)$ are the normalized autocorrelations at the first subframe of frame n, $r'_{res}(n-i)$ are the normalized autocorrelations of one of the past frames (i=1 . . . 6), and n is the frame index.

The computed averaged autocorrelations $r^{mean}_{res}$ are input to a Schur recursion algorithm to compute the two first reflection coefficients, i.e., the RESC parameters Λ, or λ(i), i=1, 2. Each of the two RESC parameters are encoded using a 2-bit scalar quantizer.

The modification of the speech encoding algorithm during DTX operation is as follows. When the SP flag is equal to "0" the speech encoding algorithm is modified in the following way. The non-averaged LP parameters which are used to derive the filter coefficients of the short-term synthesis filter H(z) of the speech encoder are not quantized, and the memory of weighing filter W(z) is not updated, but rather set to zero. The open loop pitch lag search is performed, but the closed loop pitch lag search is inactivated and the adaptive codebook gain is set to zero. If the VAD implementation does not use the delay parameter of the adaptive codebook for making the VAD decision, the open loop pitch lag search can also be switched off. No fixed codebook search is performed. In each subframe the fixed codebook excitation vector of the normal speech decoder is replaced by a random excitation vector which contains 10 non-zero pulses. The random excitation generation algorithm is defined below. The random excitation is filtered by the RESC synthesis filter, as described below, to keep the contents of the past excitation buffer as nearly equal as possible in both the encoder and the decoder, to enable a fast startup of the adaptive codebook search when the speech activity begins after the comfort noise generation period. The LP parameter quantization algorithm of the speech encoding mode is inactivated. At the end of the hangover period the reference LSF parameter vector $\hat{f}^{ref}$ is calculated as defined above. For the remainder of the comfort noise insertion period $\hat{f}^{ref}$ is frozen. The averaged LSF parameter vector $f^{mean}$ is calculated each time a new set of CN parameters is to be prepared. This parameter vector is encoded into the CN parameter message was as defined above. The excitation gain quantization algorithm of the speech encoding mode is also inactivated. The averaged random excitation gain value $g^{mean}_{cn}$ is calculated each time a new set of CN parameters is to be prepared. This gain value is encoded into the CN parameter message as previously defined. The computation of the random excitation gain is performed based on the energy of the LP residual signal, as defined above. The predictor memories of the ordinary LP parameter quantization and fixed codebook gain quantization algorithms are reset when the SP flag="0", so that the quantizers start from their initial states when the speech activity begins again. And finally, the computation of the RESC parameters is based on the spectral content of the LP residual signal, as defined above. The RESC parameters are computed each time a new set of CN parameters is to be prepared.

The comfort noise encoding algorithm produces 38 bits for each CN parameter message as shown in Table 2. These bits are referred to as vector cn[0 . . . 37]. The comfort noise bits cn[0 . . . 37] are delivered to the FACCH channel encoder in the order presented in Table 2 (i.e., no ordering according to the subjective importance of the bits is performed).

TABLE 2

Detailed bit allocation of comfort noise parameters

| Index (vector to FACCH channel encoder) | Description | Parameter |
|---|---|---|
| cn0–cn7 | Index of 1st LSF subvector | VQ index of r[1 . . . 3] |
| cn8–cn16 | Index of 2nd LSF subvector | VQ index of r[4 . . . 6] |
| cn17–cn25 | Index of 3rd LSF subvector | VQ index of r[7 . . . 10] |
| cn26–cn33 | Random excitation gain | Index of $g_{cn}^{mean}$ |
| cn34–cn35 | Index of 1st RESC parameter | Index of λ(1) |
| cn36–cn37 | Index of 2nd RESC parameter | Index of λ(2) |

Regardless of their context (speech, CN parameter message, other FACCH messages or none), the radio receiver of the base station 30 continuously passes the received traffic frames to the receive side DTX handler, individually marked by various preprocessing functions with three flags. These are the speech frame Bad Frame Indicator (BFI) flag, the comfort noise parameter Bad Frame Indicator (BFI_CN) flag, and the Comfort Noise Update Flag (CNU) described below and in Table 3. These flags serve to classify the traffic frames according to their purpose. This classification, summarized in Table 3, allows the receive side DTX handler to determine in a simple way how the received frame is to be processed.

TABLE 3

| | Classification of traffic frames | |
|---|---|---|
| | BFI_CN | |
| BFI | 0 | 1 |
| 0 | Invalid Combination | Good speech frame |
| 1 | Valid CN parameter message | Unusable frame |

The binary BFI and BFI_CN flags indicate whether the traffic frame is considered to contain meaningful information bits (BFI flag="0" and BFI_CN flag="1", or BFI flag="1" and BFI CN flag="0") or not (BFI flag="1" and BFI_CN flag="1", or BFI flag="0" and BFI_CN flag="0"). In the context of this disclosure, a FACCH frame is considered not to contain meaningful bits unless it contains a CN parameter message, and is thus marked with BFI SP flag="1" and BFI CN flag="1".

The binary CNU flag marks with CNU="1" those traffic frames that are aligned with the transmission instances of the channel quality information sent over the FACCH.

The receive side DTX handler is responsible for the overall DTX operation on the receive side. The DTX operation on the receive side is as follows: whenever a good speech frame is detected, the DTX handler passes it directly on to the speech decoder; when lost speech frames or lost CN parameter messages are detected, the substitution and muting procedure is applied; valid CN parameter messages frames result in comfort noise generation until the next CN parameter message is expected (CNU="1") or good speech frames are detected. During this period, the receive side DTX handler ignores any unusable frames delivered by the radio receiver. The following two operations are optional: the parameters of the first lost CN parameter message are substituted by the parameters of the last valid CN parameter message and the procedure for the CN parameter message is applied; and upon reception of a second lost CN parameter message, muting is applied.

With regard to the averaging and decoding of the LP parameters, when speech frames are received by the decoder the LP parameters of the last six speech frames are kept in memory. The decoder counts the number of frames elapsed since the last set of CN parameters was updated and passed to the radio transmitter by the encoder. Based on this count the decoder determines whether or not there is a hangover period at the end of the speech burst (if at least 30 frames have elapsed since the last CN parameter update when the first CN parameter message after a speech burst arrives, the hangover period is determined to have existed at the end of the speech burst).

As soon as a CN parameter message is received, and the hangover period is detected at the end of the speech burst, the stored LP parameters are averaged to obtain the reference LSF parameter vector $\hat{f}$. The reference LSF parameter vector is frozen and used for the actual comfort noise generation period.

The averaging procedure for obtaining the reference parameters is as follows:

When a speech frame is received, the LSF parameters are decoded and stored in memory. When the first CN parameter message is received, and the hangover period is detected at the end of the speech burst, the stored LSF parameters are averaged in the same way as in the speech encoder as follows:

$$\hat{f}^{ref} = \frac{1}{6}\sum_{i=1}^{6} \hat{f}(n-i) \tag{14}$$

where $\hat{f}(n-i)$ is the quantized LSF parameter vector of one of the frames of the hangover period (i=1 . . . 6), and n is the frame index.

Once the reference LSF parameter vector has been computed, the averaged LSF parameter vector $\hat{f}^{mean}(n)$ at frame n (encoded into the CN parameter message) can be reproduced at the decoder each time a CN update message is received according to the equation:

$$\hat{f}^{mean}(n)=\hat{f}(n)+\hat{f}^{ref} \tag{15}$$

where $\hat{f}^{mean}$ (n) is the quantized averaged LSF parameter vector at frame n, $\hat{f}^{ref}$ is the reference LSF parameter vector, $\hat{f}(n)$ is the received quantized LSF prediction residual vector at frame n, and n is the frame index.

In each subframe, the fixed codebook excitation vector of the normal speech decoder containing four non-zero pulses is replaced during speech inactivity by a random excitation vector which contains 10 non-zero pulses. The pulse positions and signs of the random excitation are locally generated using uniformly distributed pseudo-random numbers. The excitation pulses take values of +1 and −1 in the random excitation vector. The random excitation generation algorithm operates in accordance with the following pseudo-code.

```
Pseudo-Code:
for (i = 0; i < 40; i++)          code(i) = 0;
for (i = 0; i < 10; i++) {
j = random (4);
idx = j * 10 + i;
if (random(2) == 1)               code(idx) = 1;
else                              code(idx) = −1;
}
```

where code [0 . . . 39] is the fixed codebook excitation buffer, and random (k) generates pseudo-random integer values, uniformly distributed over the range [0 . . . k-1).

The received RESC parameter indices are decoded to obtain the received RESC parameters λ(i), i=1, 2. After the random excitation has been generated, it is filtered by the RESC synthesis filter, defined as follows:

$$H_{RESC}^{syn}(z) = \frac{1}{1+\sum_{i=1}^{2} \hat{\lambda}(i)z^{-i}} \tag{16}$$

The RESC synthesis filter is preferably implemented using a lattice filtering method. After RESC synthesis filtering, the random excitation is subjected to scaling and LP synthesis filtering.

The comfort noise generation procedure uses the speech decoder algorithm with the following modifications. The fixed codebook gain values are replaced by the random excitation gain value received in the CN parameter message, and the fixed codebook excitation is replaced by the locally generated random excitation as was described above. The random excitation is filtered by the RESC synthesis filter, as was also described above. The adaptive codebook gain value in each subframe is set to 0. The pitch delay value in each subframe is set to, for example, 60. The LP filter parameters used are those received in the CN parameter message. The predictor memories of the ordinary LP parameter and fixed codebook gain quantization algorithms are reset when the SP flag="0", so that the quantizers start from their initial states when the speech activity begins again. With these parameters, the speech decoder now performs its standard operations and synthesizes comfort noise. Updating of the comfort noise parameters (random excitation gain, RESC parameters, and LP filter parameters) occurs each time a valid CN parameter message is received, as described above. When updating the comfort noise, the foregoing parameters are interpolated over the CN update period to obtain smooth transitions.

A lost CN parameter message is defined as an unusable frame that is received when the receive side DTX handler is generating comfort noise and a CN parameter message is expected (Comfort Noise Update flag, CNU="1").

The parameters of a single lost CN parameter message are substituted by the parameters of the last valid CN parameter message and the procedure for valid CN parameters is applied. For the second lost CN parameter message, a muting technique is used for the comfort noise that gradually decreases the output level (−3 dB/frame), resulting in eventual silencing of the output of the decoder. The muting is accomplished by decreasing the random excitation gain with a constant value of −3 dB in each frame down to a minimum value of 0. This value is maintained if additional lost CN parameter messages occur.

Although a number of presently preferred embodiments of this invention have been described with respect to specific values of frame durations, numbers of frames, specific message types (e.g., FACCH) and the like, it should be realized that the numbers of frames, duration of frames, duration of the hangover period, duration of the averaging period, message types, etc., may be varied in accordance with the specifications and requirements of different types of digital mobile communications systems. Furthermore, and although the invention has been described in the context of circuit block diagrams, such as those shown in FIGS. 2*a*, 2*b*, 3*a*, 3*b*, 4, 5, and 10, it will be appreciated that some of the illustrated circuit blocks are implemented by a suitably programmed digital data processor (e.g., the controller 18 of FIG. 12) that forms a portion of the digital cellular telephone 10. By example only, the selectors 307, 319 and 410 of FIGS. 4 and 5, although shown as switches, may be implemented wholly in software.

Also, it is noted that there are Comfort Noise generation schemes in some systems where spare bits are not available in the CN parameter message (or SID frame) for transmitting the RESC parameters from the transmit side to the receive side. In those cases, the RESC filter according to the invention could be replaced by a synthesis filter with fixed coefficients. The fixed filter coefficients are then optimized to cause the frequency response of the synthesis filter to have an average response of the normal RESC filter with transmitted coefficients. The filter coefficients could be also selected to give a filter response which provides a perceptually (subjectively) preferred quality of comfort noise.

Thus, while the invention has been particularly shown and described with respect to preferred embodiments thereof, it will be understood by those skilled in the art that changes in form and details may be made therein without departing from the scope and spirit of the invention.

What is claimed is:

1. A method for producing comfort noise (CN) in a digital mobile terminal that uses a discontinuous transmission, comprising the steps of:

in response to a speech pause, calculating random excitation spectral control (RESC) parameters; and transmitting the RESC parameters to a receiver together with predetermined ones of CN parameters.

2. A method as in claim 1, wherein the step of calculating RESC parameters includes a step of analyzing a residual signal in a speech coder.

3. A method as in claim 2, wherein the speech coder implements a LPC analysis technique, and wherein the step of analyzing is of lower degree than the LPC analysis technique.

4. A method as in claim 2, wherein the speech coder implements a LPC analysis technique of order greater than two, and wherein the step of analyzing is performed by first or second order LPC analysis.

5. A method as in claim 1, wherein the step of calculating RESC parameters includes steps of analyzing a residual signal in a speech coder to produce spectral parameters, and averaging the spectral parameters over a plurality of frames to provide RESC parameters.

6. A method as in claim 3, wherein the plurality of frames is equal to about 10 or greater.

7. A method as in claim 1, wherein the step of calculating RESC parameters includes steps of applying an LPC residual signal from a speech coder inverse filter to a RESC inverse filter $H_{RESC}(Z)$ to produce a spectrally controlled residual signal which generally has a flatter spectrum than the LPC residual signal.

8. A method as in claim 7, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1, . . . , R.

9. A method as in claim 7, and further comprising a step of determining an excitation gain from the spectrally flattened residual signal.

10. A method as in claim 1, wherein the step of shaping includes steps of:

forming an excitation by generating a white noise excitation sequence;

scaling the generated white noise sequence to produce a scaled noise sequence; and processing the scaled noise sequence in a RESC filter to produce an excitation having a desired spectral content.

11. A method as in claim 1, wherein the step of calculating RESC parameters include a step of:

applying an LPC residual signal from a speech coder inverse filter to a RESC inverse filter $H_{RESC}(Z)$ to produce a spectrally controlled residual signal which generally has a flatter spectrum than the LPC residual signal, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1, . . . ,R; and wherein the step of shaping includes steps of, forming an excitation by generating a white noise excitation sequence;

scaling the generated white noise sequence to produce a scaled noise sequence; and processing the scaled noise sequence in a RESC filter to produce an excitation having a desired spectral content;

wherein the RESC filter performs an inverse operation to the RESC inverse filter and is of the form:

$$1/H_{RESC}(z) = \frac{1}{1 - \sum_{i=1}^{R} b(i)z^{-i}}.$$

12. A method as in claim 1, wherein RESC parameters $r_{mean}(i)$, i=1, . . . ,R define the filter coefficients b(i), i=1, . . . , R, are transmitted as part of the predetermined one of the CN parameters, and are used in the RESC filter to spectrally weight the excitation for the synthesis filter.

13. Apparatus for generating comfort noise (CN) in a system that uses a discontinuous transmission to a network, comprising:

means in said digital mobile terminal that is responsive to a speech pause for calculating random excitation spectral control (RESC) parameters and for transmitting the RESC parameters together with predetermined ones of CN parameters to a receiver in said network.

14. Apparatus as in claim 13, wherein said calculating means analyses a residual signal in a speech coder.

15. Apparatus as in claim 14, wherein the speech coder implements a LPC analysis technique, and wherein the analysis is of lower degree than the LPC analysis technique.

16. Apparatus as in claim 14, wherein the speech coder implements a LPC analysis technique of order greater than two, and wherein the analysis is performed by first or second order LPC analysis.

17. Apparatus as in claim 13, wherein said calculating means analyses a residual signal in a speech coder to produce spectral parameters, and further comprising means for averaging the spectral parameters over a plurality of frames to provide RESC parameters.

18. Apparatus as in claim 17, wherein the plurality of frames is equal to about 10 or greater.

19. Apparatus as in claim 13, wherein said calculating means applies an LPC residual signal from a speech coder inverse filter to a RESC inverse filter $H_{RESC}(Z)$ to produce a spectrally controlled residual signal which generally has a flatter spectrum than the LPC residual signal.

20. Apparatus as in claim 19, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1. . . , R.

21. Apparatus as in claim 19, and further comprising means for determining an excitation gain from the spectrally flattened residual signal.

22. Apparatus as in claim 13, wherein said shaping means is comprised of:

means for forming an excitation by generating a white noise excitation sequence;

means for scaling the generated white noise sequence to produce a scaled noise sequence; and means for processing the scaled noise sequence in a RESC filter to produce an excitation having a desired spectral content.

23. Apparatus as in claim 13, wherein said calculating means is comprised of:

means for applying an LPC residual signal from a speech coder inverse filter to a RESC inverse filter $H_{RESC}(z)$ to produce a spectrally controlled residual signal which generally has a flatter spectrum than the LPC residual signal, wherein the RESC inverse filter HRESC(Z) has the form of an all-zero filter described by:

$$H_{RESC}(z) = 1 - \sum_{i=1}^{R} b(i)z^{-i},$$

where b(i) represents filter coefficients, with i=1, . . . ,R; and wherein said shaping means is comprised of, means for forming an excitation by generating a white noise excitation sequence;

means for scaling the generated white noise sequence to produce a scaled noise sequence; and means for processing the scaled noise sequence in a RESC filter to produce an excitation having a desired spectral content;

wherein RESC filter performs an inverse operation to the RESC inverse filter and is of the form:

$$1/H_{RESC}(z) = \frac{1}{1 - \sum_{i=1}^{R} b(i)z^{-i}}.$$

24. Apparatus as in claim 23, wherein RESC parameters $r_{mean}(i)$, i=1, . . . ,R define the filter coefficients b(i), i=1, . . . , R, are transmitted as part of the predetermined ones of the CN parameters, and are used in the RESC filter to spectrally weight the excitation for the synthesis filter.

25. A method for producing comfort noise (CN) in a digital mobile terminal receiver that uses a discontinuous transmission, comprising the steps of:

receiving random excitation spectral (RESC) parameters; and shaping the spectral content of an excitation using the received RESC parameters prior to applying the excitation to a synthesis filter.

26. A method as in claim 25, wherein the step of calculating RESC parameters includes a step of analyzing a residual signal in a speech coder.

27. A method as in claim 26, wherein the speech coder implements a LPC analysis technique, and wherein the step of analyzing is of lower degree than the LPC analysis technique.

28. A method as in claim 26, wherein the speech coder implements a LPC analysis technique of order greater than two, and wherein the step of analyzing is performed by first or second order LPC analysis.

29. A method as in claim 25, wherein the step of calculating RESC parameters includes steps of analyzing a residual signal in a speech coder to produce spectral parameters, and averaging the spectral parameters over a plurality of frames to provide RESC parameters.

30. A method as in claim 29, wherein the plurality of frames is equal to about 10 or greater.

31. A method as in claim 25, wherein the step of calculating RESC parameters includes steps of applying an LPC residual signal from a speech coder inverse filter to a RESC inverse filter $H_{RESC}(Z)$ to produce a spectrally controlled residual signal which generally has a flatter spectrum than the LPC residual signal.

32. A method as in claim 31, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1, . . . ,R.

33. A method as in claim 31, and further comprising a step of determining an excitation gain from the spectrally flattened residual signal.

34. A method as in claim 25, wherein the step of shaping includes steps of:

forming an excitation by generating a white noise excitation sequence;

scaling the generated white noise sequence to produce a scaled noise sequence; and processing the scaled noise sequence in a RESC filter to produce an excitation having a desired spectral content.

35. A method as in claims 25, wherein the step of calculating RESC parameters include a step of:

applying an LPC residual signal from a speech coder inverse filter to a RESC inverse filter $H_{RESC}(Z)$ to produce a spectrally controlled residual signal which generally has a flatter spectrum than the LPC residual signal, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1, . . . ,R; and wherein the step of shaping includes steps of, forming an excitation by generating a white noise excitation sequence;

scaling the generated white noise sequence to produce a scaled noise sequence; and processing the scaled noise sequence in a RESC filter to produce an excitation having a desired spectral content;

wherein the RESC filter performs an inverse operation to the RESC inverse filter and is of the form:

$$1/H_{RESC}(z) = \frac{1}{1 - \sum_{i=1}^{R} b(i)z^{-i}}.$$

36. A method as in claim 35, wherein RESC parameters $r_{mean}(i)$, i=1, . . . ,R define the filter coefficients b(i), i=1, . . . , R, are transmitted as part of the predetermined one of the CN parameters, and are used in the RESC filter to spectrally weight the excitation for the synthesis filter.

37. Mobile terminal apparatus for generating comfort noise (CN) in a system that uses a discontinuous transmission to a network, comprising:

means in said mobile terminal for shaping the spectral content of an excitation using received excitation spectral control (RESC) parameters prior to applying the excitation to a synthesis filter.

38. Apparatus as in claim 37, wherein said calculating means analyses a residual signal in a speech coder.

39. Apparatus as in claim 38, wherein the speech coder implements a LPC analysis technique, and wherein the analysis is of lower degree than the LPC analysis technique.

40. Apparatus as in claim 38, wherein the speech coder implements a LPC analysis technique of order greater than two, and wherein the analysis is performed by first or second order LPC analysis.

41. Apparatus as in claim 37, wherein said calculating means analyses a residual signal in a speech coder to produce spectral parameters, and further comprising means for averaging the spectral parameters over a plurality of frames to provide RESC parameters.

42. Apparatus as in claim 41, wherein the plurality of frames is equal to about 10 or greater.

43. Apparatus as in claim 37, wherein said calculating means applies an LPC residual signal from a speech coder inverse filter to a RESC inverse filter Hhd HESC(Z) to produce a spectrally controlled residual signal which generally has a flatter spectrum than the LPC residual signal.

44. Apparatus as in claim 43, wherein the RESC inverse filter $H_{RESC}(z)$ has the form of an all-zero filter described by:

$$H_{RESC}(z) = 1 - \sum_{i=1}^{R} b(i)z^{-i},$$

where b(i) represents filter coefficients, with i=1, . . . ,R.

45. Apparatus as in claim 43, and further comprising means for determining an excitation gain from the spectrally flattened residual signal.

46. Apparatus as in claim 37, wherein said shaping means is comprised of:

means for forming an excitation by generating a white noise excitation sequence;

means for scaling the generated white noise sequence to produce a scaled noise sequence; and means for processing the scaled noise sequence in a RESC filter to produce an excitation having a desired spectral content.

47. Apparatus as in claim 37, wherein said calculating means is comprised of:

means for applying an LPC residual signal from a speech coder inverse filter to a RESC inverse filter $H_{RESC}(Z)$ to produce a spectrally controlled residual signal which generally has a flatter spectrum than the LPC residual signal, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1, . . . ,R; and wherein said shaping means is comprised of, means for forming an excitation by generating a white noise excitation sequence;

means for scaling the generated white noise sequence to produce a scaled noise sequence; and means for processing the scaled noise sequence in a RESC filter to produce an excitation having a desired spectral content;

wherein RESC filter performs an inverse operation to the RESC inverse filter and is of the form:

$$1/H_{RESC}(z) = \frac{1}{1 - \sum_{i=1}^{R} b(i)z^{-i}}.$$

48. Apparatus as in claim 47, wherein RESC parameters $r_{mean}(i)$, i=1, . . . ,R define the filter coefficients b(i), i=1, . . . , R, are transmitted as part of the predetermined ones of the CN parameters, and are used in the RESC filter to spectrally weight the excitation for the synthesis filter.

49. A method for producing comfort noise (CN) in a network element that uses a discontinuous transmission, comprising the steps of:

receiving excitation spectral control (RESC) parameters; and shaping the spectral content of an excitation using the received RESC parameters prior to applying the excitation to a synthesis filter.

50. A method as in claim 49, wherein the step of calculating RESC parameters includes a step of analyzing a residual signal in a speech coder.

51. A method as in claim 50, wherein the speech coder implements a LPC analysis technique, and wherein the step of analyzing is of lower degree than the LPC analysis technique.

52. A method as in claim 50, wherein the speech coder implements a LPC analysis technique of order greater than two, and wherein the step of analyzing is performed by first or second order LPC analysis.

53. A method as in claim 49, wherein the step of calculating RESC parameters includes steps of analyzing a residual signal in a speech coder to produce spectral parameters, and averaging the spectral parameters over a plurality of frames to provide RESC parameters.

54. A method as in claim 53, wherein the plurality of frames is equal to about 10 or greater.

55. A method as in claim 49, wherein the step of calculating RESC parameters includes steps of applying an LPC residual signal from a speech coder inverse filter to a RESC inverse filter $H_{RESC}(Z)$ to produce a spectrally controlled residual signal which generally has a flatter spectrum than the LPC residual signal.

56. A method as in claim 55, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1, . . . ,R.

57. A method as in claim 55, and further comprising a step of determining an excitation gain from the spectrally flattened residual signal.

58. A method as in claim 49, wherein the step of shaping includes steps of:

forming an excitation by generating a white noise excitation sequence;

scaling the generated white noise sequence to produce a scaled noise sequence; and processing the scaled noise sequence in a RESC filter to produce an excitation having a desired spectral content.

59. A method as in claim 49, wherein the step of calculating RESC parameters include a step of:

applying an LPC residual signal from a speech coder inverse filter to a RESC inverse filter $H_{RESC}(Z)$ to produce a spectrally controlled residual signal which generally has a flatter spectrum than the LPC residual signal, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1, . . . ,R; and wherein the step of shaping includes steps of, forming an excitation by generating a white noise excitation sequence;

scaling the generated white noise sequence to produce a scaled noise sequence; and processing the scaled noise sequence in a RESC filter to produce an excitation having a desired spectral content;

wherein the RESC filter performs an inverse operation to the RESC inverse filter and is of the form:

$$1/H_{RESC}(z) = \frac{1}{1 - \sum_{i=1}^{R} b(i)z^{-i}}.$$

60. A method as in claim 59, wherein RESC parameters $r_{mean}(i)$, i=1, . . . ,R define the filter coefficients b(i), i=1, . . . , R, are transmitted as part of the predetermined one of the CN parameters, and are used in the RESC filter to spectrally weight the excitation for the synthesis filter.

61. Apparatus for generating comfort noise (CN) in a system having a digital mobile terminal that uses a discontinuous transmission to a network, comprising:

means in said network for shaping the spectral content of an excitation using received excitation spectral control (RESC) parameters prior to applying the excitation to a synthesis filter.

62. Apparatus as in claim 61, wherein said calculating means analyses a residual signal in a speech coder.

63. Apparatus as in claim 63, wherein the speech coder implements a LPC analysis technique, and wherein the analysis is of lower degree than the LPC analysis technique.

64. Apparatus as in claim 62, wherein the speech coder implements a LPC analysis technique of order greater than two, and wherein the analysis is performed by first or second order LPC analysis.

65. Apparatus as in claim 61, wherein said calculating means analyses a residual signal in a speech coder to produce spectral parameters, and further comprising means for averaging the spectral parameters over a plurality of frames to provide RESC parameters.

66. Apparatus as in claim 65, wherein the plurality of frames is equal to about 10 or greater.

67. Apparatus as in claim 61, wherein said calculating means applies an LPC residual signal from a speech coder inverse filter to a RESC inverse filter $H_{RESC}(Z)$ to produce a spectrally controlled residual signal which generally has a flatter spectrum than the LPC residual signal.

68. Apparatus as in claim 67, wherein the RESC inverse filter $H_{RESC}(z)$ has the form of an all-zero filter described by:

$$H_{RESC}(z) = 1 - \sum_{i=1}^{R} b(i)z^{-i},$$

where b(i) represents filter coefficients, with i=1, . . . ,R.

69. Apparatus as in claim 67, and further comprising means for determining an excitation gain from the spectrally flattened residual signal.

70. Apparatus as in claim 61, wherein said shaping means is comprised of:

means for forming an excitation by generating a white noise excitation sequence;

means for scaling the generated white noise sequence to produce a scaled noise sequence; and means for processing the scaled noise sequence in a RESC filter to produce an excitation having a desired spectral content.

71. Apparatus as in claim 61, wherein said calculating means is comprised of:

means for applying an LPC residual signal from a speech coder inverse filter to a RESC inverse filter $H_{RESC}(Z)$ to produce a spectrally controlled residual signal which generally has a flatter spectrum than the LPC residual signal, wherein the RESC inverse filter $H_{RESC}(Z)$ has the form of an all-zero filter described by:

$$H_{RESC}(z) = 1 - \sum_{i=1}^{R} b(i)z^{-i},$$

where b(i) represents filter coefficients, with i=1, . . . ,R; and wherein said shaping means is comprised of, means for forming an excitation by generating a white noise excitation sequence;

means for scaling the generated white noise sequence to produce a scaled noise sequence; and means for processing the scaled noise sequence in a RESC filter to produce an excitation having a desired spectral content;

wherein RESC filter performs an inverse operation to the RESC inverse filter and is of the form:

$$1/H_{RESC}(z) = \frac{1}{1 - \sum_{i=1}^{R} b(i)z^{-i}}.$$

72. Apparatus as in claim 71, wherein RESC parameters $r_{mean}(i)$, i=1, . . . ,R define the filter coefficients b(i), i=1, . . . , R, are transmitted as part of the predetermined ones of the CN parameters, and are used in the RESC filter to spectrally weight the excitation for the synthesis filter.

73. A method for producing comfort noise (CN) in a digital network element that uses a discontinuous transmission, comprising the steps of:

in response to a speech pause, calculating random excitation spectral control (RESC) parameters; and transmitting the RESC parameters to a receiver together with predetermined ones of CN parameters.

74. A method as in claim 73, wherein the step of calculating RESC parameters includes a step of analyzing a residual signal in a speech coder.

75. A method as in claim 74, wherein the speech coder implements a LPC analysis technique, and wherein the step of analyzing is of lower degree than the LPC analysis technique.

76. A method as in claim 74, wherein the speech coder implements a LPC analysis technique of order greater than two, and wherein the step of analyzing is performed by first or second order LPC analysis.

77. A method as in claim 73, wherein the step of calculating RESC parameters includes steps of analyzing a residual signal in a speech coder to produce spectral parameters, and averaging the spectral parameters over a plurality of frames to provide RESC parameters.

78. A method as in claim 77, wherein the plurality of frames is equal to about 10 or greater.

79. A method as in claim 73, wherein the step of calculating RESC parameters includes steps of applying an LPC residual signal from a speech coder inverse filter to a RESC inverse filter $H_{RESC}(Z)$ to produce a spectrally controlled residual signal which generally has a flatter spectrum than the LPC residual signal.

80. A method as in claim 79, wherein the RESC inverse filter $H_{RESC}(z)$ has the form of an all-zero filter described by:

$$H_{RESC}(z) = 1 - \sum_{i=1}^{R} b(i)z^{-i},$$

where b(i) represents filter coefficients, with i=1, . . . ,R.

81. A method as in claim 79, and further comprising a step of determining an excitation gain from the spectrally flattened residual signal.

82. A method as in claim 73, wherein the step of shaping includes steps of:

forming an excitation by generating a white noise excitation sequence;

scaling the generated white noise sequence to produce a scaled noise sequence; and processing the scaled noise sequence in a RESC filter to produce an excitation having a desired spectral content.

83. A method as in claim 73, wherein the step of calculating RESC parameters include a step of:

applying an LPC residual signal from a speech coder inverse filter to a RESC inverse filter $H_{RESC}(z)$ to produce a spectrally controlled residual signal which generally has a flatter spectrum than the LPC residual signal, wherein the RESC inverse filter $H_{RESC}(z)$ has the form of an all-zero filter described by:

$$H_{RESC}(z) = 1 - \sum_{i=1}^{R} b(i)z^{-i},$$

where b(i) represents filter coefficients, with i=1, . . . ,R; and wherein the step of shaping includes steps of, forming an excitation by generating a white noise excitation sequence;

scaling the generated white noise sequence to produce a scaled noise sequence; and processing the scaled noise sequence in a RESC filter to produce an excitation having a desired spectral content;

wherein the RESC filter performs an inverse operation to the RESC inverse filter and is of the form:

$$1/H_{RESC}(z) = \frac{1}{1 - \sum_{i=1}^{R} b(i)z^{-i}}.$$

84. A method as in claim 83, wherein RESC parameters $r_{mean}(i)$, i=1, . . . ,R define the filter coefficients b(i), i=1, . . . , R, are transmitted as part of the CN parameters, and are used in the RESC filter to spectrally weight the excitation for the synthesis filter.

85. Apparatus for generating comfort noise (CN) in a system having a network element that uses a discontinuous transmission, comprising:

means in said network element that is responsive to a speech pause for calculating random excitation spectral control (RESC) parameters and for transmitting the RESC parameters together with predetermined ones of CN parameters to a receiver in said network.

86. Apparatus as in claim 85, wherein said calculating means analyses a residual signal in a speech coder.

87. Apparatus as in claim 86, wherein the speech coder implements a LPC analysis technique, and wherein the analysis is of lower degree than the LPC analysis technique.

88. Apparatus as in claim 86, wherein the speech coder implements a LPC analysis technique of order greater than two, and wherein the analysis is performed by first or second order LPC analysis.

89. Apparatus as in claim 85, wherein said calculating means analyses a residual signal in a speech coder to produce spectral parameters, and further comprising means for averaging the spectral parameters over a plurality of frames to provide RESC parameters.

90. Apparatus as in claim 89, wherein the plurality of frames is equal to about 10 or greater.

91. Apparatus as in claim 85, wherein said calculating means applies an LPC residual signal from a speech coder inverse filter to a RESC inverse filter $H_{RESC}(z)$ to produce a spectrally controlled residual signal which generally has a flatter spectrum than the LPC residual signal.

92. Apparatus as in claim 91, wherein the RESC inverse filter $H_{RESC}(z)$ has the form of an all-zero filter described by:

$$H_{RESC}(z) = 1 - \sum_{i=1}^{R} b(i)z^{-i},$$

where b(i) represents filter coefficients, with i=1, . . . ,R.

93. Apparatus as in claim 91, and further comprising means for determining an excitation gain from the spectrally flattened residual signal.

94. Apparatus as in claim 85, wherein said shaping means is comprised of:

means for forming an excitation by generating a white noise excitation sequence;

means for scaling the generated white noise sequence to produce a scaled noise sequence; and means for processing the scaled noise sequence in a RESC filter to produce an excitation having a desired spectral content.

95. Apparatus as in claim 85, wherein said calculating means is comprised of:

means for applying an LPC residual signal from a speech coder inverse filter to a RESC inverse filter $H_{RESC}(z)$ to produce a spectrally controlled residual signal which generally has a flatter spectrum than the LPC residual signal, wherein the RESC inverse filter $H_{RESC}(z)$ has the form of an all-zero filter described by:

$$H_{RESC}(z) = 1 - \sum_{i=1}^{R} b(i)z^{-i},$$

where b(i) represents filter coefficients, with i=1, . . . ,R; and wherein said shaping means is comprised of, means for forming an excitation by generating a white noise excitation sequence;

means for scaling the generated white noise sequence to produce a scaled noise sequence; and means for processing the scaled noise sequence in a RESC filter to produce an excitation having a desired spectral content;

wherein RESC filter performs an inverse operation to the RESC inverse filter and is of the form:

$$1/H_{RESC}(z) = \frac{1}{1 - \sum_{i=1}^{R} b(i)z^{-i}}.$$

96. Apparatus as in claim 95, wherein RESC parameters $r_{mean}(i)$, i=1, . . . ,R define the filter coefficients b(i), i=1, . . . , R, are transmitted as part of the predetermined ones of the CN parameters, and are used in the RESC filter to spectrally weight the excitation for the synthesis filter.

97. A method for generating comfort noise (CN) in an element of a mobile communications network that uses a discontinuous transmission, comprising the steps of:

in response to a speech pause, buffering a set of speech coding parameters;

within an averaging period, replacing speech coding parameters of the set that are not representative of background noise with speech coding parameters that are representative of the background noise; and averaging the set of speech coding parameters.

98. A method as in claim 97, wherein the step of replacing includes the steps of:

measuring distances of the speech coding parameters from one another between individual frames within the averaging period;

identifying those speech coding parameters which have the largest distances to the other parameters within the averaging period; and if the distances exceed a predetermined threshold, replacing an identified speech coding parameter with a speech coding parameter which has a smallest measured distance to the other speech coding parameters within the averaging period.

99. A method as in claim 97, wherein the step of replacing includes the steps of:

measuring distances of the speech coding parameters from one another between individual frames within the averaging period;

identifying those speech coding parameters which have the largest distances to the other parameters within the averaging period; and if the distances exceed a predetermined threshold, replacing an identified speech coding parameter with a speech coding parameter having a median value.

100. A method as in claim 97, wherein the step of averaging includes a step of computing an average excitation gain $g_{mean}$ and average short term spectral coefficients $f_{mean}(i)$.

101. A method as in claim 97, wherein the step of replacing includes steps of:

forming a set of buffered excitation gain values over the averaging period;

ordering the set of buffered excitation gain values; and performing a median replacement operation in which those L excitation gain values differing the most from the median value, where the difference exceeds a predetermined threshold value, are replaced by the median value of the set.

102. A method as in claim 101, wherein a length N of the averaging period is an odd number, and wherein the median of the ordered set is the ((N+1)/2)th element of the set.

103. A method as in claim 97, and further comprising a step of:

forming a set of buffered Line Spectral Pair (LSP) coefficients f(k), k=1, . . . ,M over the averaging period; and determining a spectral distance of the LSP coefficients $f_i(k)$ of the ith frame in the averaging period, to the LSP coefficients $f_j(k)$ of the jth frame in the averaging period.

104. A method as in claim 103, where the step of determining the spectral distance is accomplished in accordance with the expression $$\Delta R_{ij} = \sum_{k=1}^{M} (f_i(k) - f_j(k))^2,$$

where M is the degree of the LPC model, and $f_i(k)$ is the kth LSP parameter of the ith frame in the averaging period.

105. A method as in claim 103, and further comprising a step of determining the spectral distance $\Delta S_i$ of the LSP coefficients $f_i(k)$ of frame i to the LSP coefficients of all the other frames j=1, . . . ,N, i≠j, within the averaging period of length N.

106. A method as in claim 105, wherein the step of determining the spectral distance is accomplished by determining the sum of the spectral distances $\Delta R_{ij}$ in accordance with $$\Delta S_i = \sum_{j=1, j\neq i}^{N} \Delta R_{ij},$$

for all i=1, . . . ,N.

107. A method as in claim 105, and further comprising steps of:

after the spectral distances $\Delta S_i$ have been found for each of the LSP vectors $f_i$ within the averaging period, ordering the spectral distances according to their values;

considering a vector $f_i$ with the smallest distance $\Delta S_i$ within the averaging period i=1, 2,. . . ,N to be a median vector $f_{med}$ of the averaging period having a distance denoted as $\Delta S_{med}$; and performing a median replacement of P (0≦P≦N-1) LSP vectors $f_i$ with the median vector $f_{med}$.

108. A method as in claim 107, wherein the steps of identifying and replacing are performed independently for excitation gain values g and Line Spectral Pair (LSP) vectors $f_i$.

109. A method as in claim 98, wherein the steps of identifying and replacing are combined together for excitation gain values g and Line Spectral Pair (LSP) vectors $f_i$.

110. A method as in claim 109, comprising steps of:

in response to determining that the speech coding parameters in an individual frame are to be replaced by median values of the parameters, replacing both the excitation gain value g and the LSP vector $f_i$ of that frame by the respective parameters of the frame containing the median parameters.

111. A method as in claim 110, and comprising initial steps of:

determining a distance $\Delta T_{ij}$ between the parameters of the ith frame and the jth frame of the averaging period in accordance with the expression $$\Delta T_{ij} = \sum_{k=1}^{M} (f_i(k) - f_j(k))^2 + w(g_i - g_j)^2,$$

where M is the degree of the LPC model, $f_i(k)$ is the kth LSP parameter of the ith frame of the averaging period, and $g_i$ is the excitation gain parameter of the ith frame.

112. A method as in claim 111, and further comprising a step of:

determining a distance $\Delta S_i$ of the speech coding parameters of frame i, for all i=1, . . . ,N, to the speech coding parameters of all the other frames j=1, . . . ,N, i≠j within the averaging period of length N, in accordance with $$\Delta S_i = \sum_{j=1, j\neq i}^{N} \Delta T_{ij},$$

for all i=1, . . . ,N.

113. A method as in claim 112, wherein after the distances $\Delta S_i$ have been determined for each of the frames within the averaging period, further comprising steps of:

ordering the distances according to their values; and considering a frame with the smallest distance $\Delta S_i$ within the averaging period i=1,2, . . . ,N as a median frame, having distance $\Delta S_{med}$, of the averaging period, the median frame having speech coder parameters $g_{med}$ and $f_{med}$.

114. A method as in claim 113, and comprising a step of performing median replacement on the speech coding parameter frames within the averaging period i=1,2, . . . ,N wherein parameters $g_i$ and $f_i$ of L (0≦L≦N-1) frames are replaced by the parameters $g_{med}$ and $f_{med}$ of the median frame.

115. A method as in claim 113, wherein differences between each individual distance and the median distance are determined by dividing an individual distance by the median distance in accordance with $\Delta S_i/\Delta S_{med}$.

116. A method as in claim 107, wherein differences between each individual distance and the median distance are determined by dividing an individual distance by the median distance in accordance with $\Delta S_i/\Delta S_{med}$.

117. Apparatus for generating comfort noise (CN) in an element of a mobile communication network that uses a discontinuous transmission to a network, comprising:

data processing means in network element that is responsive to a speech pause for buffering a set of speech coding parameters and, within an averaging period, for replacing speech coding parameters of the set that are not representative of background noise with speech coding parameters that are representative of the background noise, said data processing means averaging the set of speech coding parameters and transmitting the averaged set of speech coding parameters to the mobile terminal.

118. Apparatus as in claim 117, wherein said data processor replaces speech coding parameters of the set by ordering the set and measuring distances of the speech coding parameters from one another between individual frames within the averaging period, by identifying those speech coding parameters which have the largest distances to the other parameters within the averaging period; and, if the distances exceed a predetermined threshold, by replacing the identified speech coding parameters with a speech coding parameter which has a smallest measured distance to the other speech coding parameters within the averaging period.

119. Apparatus as in claim 117, wherein said data processor replaces speech coding parameters of the set by ordering the set and measuring distances of the speech coding parameters from one another between individual frames within the averaging period; by identifying those speech coding parameters which have the largest distances to the other parameters within the averaging period; and, if the distances exceed a predetermined threshold, by replacing an identified speech coding parameter with a speech coding parameter having a median value.

120. Apparatus as in claim 117, wherein said data processing means identifies and replaces speech coding parameters independently for excitation gain values g and Line Spectral Pair (LSP) vector $f_i$.

121. Apparatus as in claim 117, wherein said data processing means identifies and replaces speech coding parameters together for excitation gain values g and Line Spectral Pair (LSP) vector $f_i$.

* * * * *

UNITED STATES PATENT AND TRADEMARK OFFICE

CERTIFICATE OF CORRECTION

PATENT NO. : 6,606,593 B1
DATED : August 12, 2003
INVENTOR(S) : Jarvinen et al.

It is certified that error appears in the above-identified patent and that said Letters Patent is hereby corrected as shown below:

Column 30,
Line 21, “claim 3” should read -- claim 5 --.

Column 31,
Line 11, “claim 1” should read -- claim 11 --.

Column 33,
Line 21, “claims 25” should read -- claim 25 --.

Column 34,
Line 14, please delete “Hhd”.

Column 41,
Line 59, “(0≦P≦N-1)” should read -- 0≤P≤N-1) --.

Column 42,
Line 47, “(0≦L≦N-1)” should read -- 0≤L≤N-1) --.

Signed and Sealed this

Third Day of February, 2004

JON W. DUDAS
*Acting Director of the United States Patent and Trademark Office*